US006964520B1

(12) United States Patent
Sakai et al.

(10) Patent No.: US 6,964,520 B1
(45) Date of Patent: Nov. 15, 2005

(54) PACKAGING BAG

(75) Inventors: Hiroshi Sakai, Tosu (JP); Hiroyuki Taketomi, Tosu (JP); Yuji Hashitani, Tosu (JP); Hirofumi Okada, Osaka (JP); Shinichi Hirakawa, Osaka (JP)

(73) Assignees: Hisamitsu Pharmaceutical Co., Inc., Saga (JP); Okada Shigyo Co., Ltd., Osaka (JP); Toppan Printing Co., Ltd., Tokyo (JP)

( * ) Notice: Subject to any disclaimer, the term of this patent is extended or adjusted under 35 U.S.C. 154(b) by 0 days.

(21) Appl. No.: 10/204,476

(22) PCT Filed: Feb. 22, 2001

(86) PCT No.: PCT/JP01/01288

§ 371 (c)(1),
(2), (4) Date: Dec. 9, 2002

(87) PCT Pub. No.: WO01/62616

PCT Pub. Date: Aug. 30, 2001

(30) Foreign Application Priority Data

Feb. 22, 2000 (JP) ..... 2000-44594

(51) Int. Cl.[7] ..... B65D 33/00

(52) U.S. Cl. ..... 383/207; 383/204; 383/208; 383/209; 383/116

(58) Field of Search ..... 383/207, 208, 383/209, 116; 229/87.05, 237

(56) References Cited

U.S. PATENT DOCUMENTS 1,516,090 A * 11/1924 Gary et al. ..... 229/243
2,117,738 A * 5/1938 Otto ..... 383/209
2,967,010 A * 1/1961 Cuffey, Jr. et al. ..... 428/43
3,146,912 A * 9/1964 Twersky ..... 222/107
3,451,539 A * 6/1969 Wysocki ..... 426/122
3,514,032 A * 5/1970 Pierce ..... 229/227
4,008,849 A * 2/1977 Baber ..... 229/237
5,198,276 A * 3/1993 Nakajima ..... 428/43

FOREIGN PATENT DOCUMENTS

| | | |
|---|---|---|
| JP | 7-35365 | 6/1995 |
| JP | 8-324597 | 12/1996 |
| JP | 2566444 | 12/1997 |

* cited by examiner

*Primary Examiner*—Jes F. Pascua
(74) *Attorney, Agent, or Firm*—Kendrew H. Colton; Fitch Even Tabin & Flannery

(57) ABSTRACT

In a bag 10 for packaging having a first face 10A and a second face 10B that are mutually opposite, a first line of weakness 100A (100B) and a second line of weakness 200A (200B) and a third line of weakness 300A (300B) constituted by a plurality of breaks of perforation form arranged between the first line of weakness and the second line of weakness and having an inclination with respect to a prescribed unsealing direction L50 are respectively formed in the first face and the second face such that these are arranged in mutually parallel fashion, and the plurality of breaks of perforation form constituting the third line of weakness formed in the first face and the plurality of breaks of perforation form constituting the third line of weakness formed in the second face are formed inclined in mutually opposite directions with respect to the prescribed unsealing direction. In this way a finger-grip portion of suitable extent is formed at the unsealed aperture of the bag for packaging after unsealing.

10 Claims, 12 Drawing Sheets

PACKAGING BAG

CROSS-REFERENCED APPLICATIONS

This application is a National phase of International Application PCT/JP01/01288, filed Feb. 22, 2001, which designated the U.S. and that International Application was not published under PCT Article 21(2) in English.

TECHNICAL FIELD

The present invention relates to a bag for packaging having a line of weakness for unsealing.

BACKGROUND ART

Bags for packaging are previously known as shown by the front view of FIG. 11(A) and the opened-out view of FIG. 11(B). In order to facilitate the task of unsealing, such a bag 1000 for packaging is provided with lines of weakness in the form of perforations or modified perforations on a pair of opposite faces of bag 1000 (hereinbelow, the line of weakness provided of one of these mutually opposite faces 1000A will be called "line of weakness 2000" and the line of weakness provided on the other face 1000B will be termed "line of weakness 3000"). With the conventional bag for packaging 1000, the unsealing task can easily be performed by tearing using the region of line of weakness 2000 and line of weakness 3000 that are respectively provided in first face 1000A and second face 1000B. For example, Japanese Utility Model Number 2566444 discloses a bag for packaging provided with lines of weakness in the form of modified perforations.

DISCLOSURE OF THE INVENTION

However, with the conventional bag 1000 for packaging shown in FIG. 11(A) and FIG. 11(B), as shown in FIG. 12(A), there is the inconvenience that the unsealed aperture 4000 of bag 1000 produced after unsealing is easily closed in a sealed condition so it is difficult to easily extract the packaged articles in the bag 1000 by quickly opening this unsealed aperture 4000 when needed.

The present invention was made in view of the above problem of the prior art, its object being to provide a bag for packaging that can easily be manufactured and wherein the unsealing operation is easy and opening/closing of the unsealed aperture after unsealing can easily be effected.

As a result of meticulous investigations aimed at achieving the above object, the present inventors discovered that, as shown by the opened-out view of FIG. 12B, in a conventional bag 1000 for packaging, the occurrence of this inconvenience is greatly influenced by the fact that the border portion 5000 along the line of weakness 2000 of the first face and border portion 6000 along line of weakness 3000 of the second face that form unsealed aperture 4000 after unsealing tend to adhere together with the result that unsealed aperture 4000 easily becomes closed and once it is closed it is not easy to grip with the finger-tips one or other of the border portion 5000 or border portion 6000. They discovered that, in order to solve the aforementioned inconvenience, the unsealed aperture could easily be opened even after closure of the unsealed aperture by utilizing a finger-grip portion i.e. a portion capable of being gripped by the fingers (hereinbelow termed "finger-grip portion") formed at the unsealed aperture after unsealing.

Specifically, a bag for packaging according to the present invention comprises a first face and a second face that are mutually opposite wherein a first line of weakness and a second line of weakness and a third line of weakness constituted by a plurality of breaks of perforation form arranged between the first line of weakness and the second line of weakness and having an inclination with respect to a prescribed unsealing direction, these being arranged in mutually parallel fashion, are respectively formed in the first face and the second face, the plurality of breaks of perforation form constituting the third line of weakness formed in the first face and the plurality of breaks of perforation form constituting the third line of weakness formed in the second face being formed inclined in mutually opposite directions with respect to the prescribed unsealing direction.

Since, as described above, the plurality of breaks of perforation form constituting the third line of weakness formed in the first face and the plurality of breaks of perforation form constituting the third line of weakness formed in the second face are formed inclined in mutually opposite directions with respect to the prescribed unsealing direction, a finger-grip portion is formed based on this plurality of breaks in perforation form at the unsealed aperture after unsealing. Opening and closure of the unsealed aperture can therefore easily be carried out utilizing this finger-grip portion. Also, thanks to the third line of weakness arranged between the first line of weakness and second line of weakness, the finger-grip portion can be reliably formed in a desired region of the unsealed aperture after unsealing.

The "lines of weakness" referred to herein are formed by performing break processing etc of linear form or perforation form on the packaging material that forms the bag for packaging so that unsealing without using a blade can thereby easily be effected by tearing the bag for packaging. "Break processing in linear form" indicates formation of continuous linear grooves leaving a slight thickness of the packaging material; "break processing in perforation form" indicates continuous formation of slits or grooves in the packaging material, leaving prescribed separations.

In the bag for packaging according to the present invention, one of the mutually opposite faces of the bag for packaging is termed the "first face" while the other face is termed the "second face". Furthermore, the edge of the opening that is actually produced in the first face and second face by tearing of the bag for packaging during the unsealing operation with a bag for packaging according to the present invention is termed the "unsealing line".

Also, in a bag for packaging according to the present invention, it will be assumed that this unsealing line is produced by tearing the bag for packaging along a third line of weakness that is respectively provided in the first face and second face. That is, it is proposed that, with the bag for packaging of present invention, the user effects unsealing by utilizing the third line of weakness. Consequently, with the bag for packaging of the present invention, the position of commencement of unsealing of the bag for packaging when the unsealing operation is performed is preferably at the end of the third line of weakness of both the first face and second face.

Furthermore, it is preferable that the third lines of weakness respectively provided in the first face and second face should be mutually arranged in a condition wherein, if the third line of weakness on the first face moves in parallel over the second face along the normal direction of this first face, the third line of weakness of the first face and the third line of weakness of second face overlap in a range wherein at least part of the end portions thereof can share said position of commencement of unsealing on the second face.

Also, just as in the case of the third line of weakness aforementioned, preferably, if the first line of weakness on the first face is moved in parallel fashion over the second face along the normal direction of this first face, the first lines of weakness respectively provided on the first face and second face are mutually arranged in the same condition as the aforementioned third line of weakness. That is, so long as these first lines of weakness are in a range in which a finger-grip portion can be formed having the desired area, making use of the inclination of the third line of weakness, they may be arranged having a mutual offset in the perpendicular direction with respect to the desired unsealing direction.

Furthermore, the second lines of weakness respectively provided in the first face and second face are arranged so as to satisfy the same conditions as the position of relative arrangement of the first lines of weakness respectively provided in the first face and second face.

Also, the "third line of weakness" in the bag for packaging according to the present invention denotes a line of weakness provided with the intention of causing the direction of advance of the unsealing line, once it has deviated from the prescribed unsealing direction at some point along this third line of weakness, causing this direction of advance that is actually formed in the first face and second face along this third line of weakness from the point of commencement of unsealing (i.e. the end of the third line of weakness) during the unsealing operation, to proceed from the region of formation of the third line of weakness towards the region where the first line of weakness or second line of weakness that is formed in the first face is formed, by the action of a plurality of breaks of perforation form having an inclination with respect to the desired unsealing direction.

The inclination which the plurality of breaks in the form of perforations of the third line of weakness have with respect to the desired unsealing direction is suitably set in accordance with the load acting on each line of weakness in each face on unsealing such that the unsealing line can be made to deviate smoothly from the third line of weakness. In the following description, the inclination possessed by the plurality of breaks in the form of perforations of the third line of weakness with respect to the desired unsealing direction is termed the "inclination of the breaks of the third line of weakness".

In addition, the "first line of weakness" and "second line of weakness" that are respectively formed in the first and second faces denote lines of weakness provided with the intention of trapping an unsealing line advancing deviating from the desired unsealing direction in this formation region, due to the third line of weakness during unsealing, preventing advance of the unsealing line further to the outside from this formation region and again converting the direction of the advance of the unsealing line in this region of formation into the desired unsealing direction.

Also, the condition that "the plurality of breaks of perforation form constituting the third line of weakness formed in the first face and the plurality of breaks of perforation form constituting the third line of weakness formed in the second face are formed inclined in mutually opposite directions with respect to the prescribed unsealing direction" denotes the condition that the third lines of weakness respectively in the first face and second face are formed such that the direction in which the unsealing line deviates from the desired unsealing direction due to the inclination of the breaks of the third line of weakness of the first face on the side of the first face and the direction in which the unsealing line deviates from the desired unsealing direction due to the inclination of the breaks of the third line of weakness of the second face on the side of the second face are opposite directions. Specifically, it indicates that respective third lines of weakness are formed in the first face and second face such that, when an unsealing line proceeding through the region where the third line of weakness is formed in the first face deviates in the direction of the first line of weakness (or the direction of the second line of weakness) from the desired unsealing direction, the unsealing line proceeding through the region where the third line of weakness is formed in the second face deviates in the direction of the second line of weakness (or the direction of the first line of weakness) from the desired unsealing direction.

In this way, by formation of a plurality of breaks of perforation form constituting a third line of weakness formed in the first face and a plurality of breaks of perforation form constituting a third line of weakness formed in the second face inclined in opposite directions with respect to the prescribed unsealing direction, if unsealing of the bag for packaging is performed from an unsealing commencement position constituted by a portion where corresponding ends of the third line of weakness respectively provided in the first face and second face overlap, the unsealing line that proceeds simultaneously through the first face and second face during the unsealing operation is formed as follows.

Specifically, the unsealing line that proceeds along the third line of weakness of the first face through the first face during the unsealing operation is made to deviate in its direction of advance from the desired unsealing direction by the inclination of the plurality of breaks of perforation form of the third line of weakness and is thus controlled so as to advance towards the first line of weakness on the first face (or second line of weakness on the first face) until it arrives at the first line of weakness (or second line of weakness). The unsealing line that has arrived at the first line of weakness (or second line of weakness) on the first face is then again controlled by the first line of weakness (or second line of weakness) so that its direction of advance faces the desired unsealing direction and thus finally proceeds along this first line of weakness (or second line of weakness) on the first face.

Meanwhile, the unsealing line that advances along the third line of weakness of the second face through the second face during the unsealing operation is made to deviate in its direction of advance from the desired unsealing direction by the inclination of the plurality of breaks of perforation form of the third line of weakness and is thus controlled so as to advance towards the second line of weakness on the first face (or first line of weakness on this first face) until it arrives at the second line of weakness on the first face (or first line of weakness on this face). The unsealing line that has arrived at the second line of weakness (or first line of weakness) on the second face is then again controlled by the second line of weakness (or first line of weakness) so that its direction of advance faces the desired unsealing direction and thus finally proceeds along this second line of weakness (or first line of weakness) on the second face.

In this way, the unsealing line that is produced in the first face is formed along the first line of weakness of the first face (or second line of weakness) and the unsealing line that has produced in the second face is formed along the second line of weakness of the second face (or first line of weakness); as a result, a finger-grip portion is formed in accordance with the magnitude of the distance between the first line of weakness (or second line of weakness) of the first face in one or other of the first face and second face and the second line of weakness (or first line of weakness) of the second face.

Also, since a finger-grip portion after unsealing can easily be formed by forming the third line of weakness respectively provided in the first face and second face as described above such that the plurality of breaks of perforation form constituting the third line of weakness formed in the first face and the plurality of breaks in perforation form constituting the third line of weakness forming the second face are inclined in opposite directions with respect to the prescribed unsealing direction, there is no need to form a special finger-grip portion beforehand such as to be provided in the anticipated vicinity of the unsealed aperture.

Also, in the bag for packaging according to the present invention, the third line of weakness is preferably formed as an assembly consisting of 1 to 10 lines of weakness. In this way, it is possible to reliably ensure that the area of the finger-grip portion that is formed at the unsealed aperture after unsealing is of sufficient size, so that it can be easily gripped with the fingers.

Also, preferably, the plurality of breaks in perforation form constituting the third line of weakness in the bag for packaging according to the present invention are formed so as to have an inclination of 25 to 45° with respect to the prescribed unsealing direction. In this way, the direction of advance of the unsealing line advancing through the region of formation of the third line of weakness formed respectively in the first face and second face during unsealing can be made to deviate in a smoother fashion from the desired unsealing direction towards the direction of the first line of weakness or second line of weakness.

Also, in the bag for packaging according to the present invention, preferably the first line of weakness and/or second line of weakness are formed as an assembly consisting of 1 to 10 lines of weakness. In this way, on unsealing, the unsealing line deviating from the desired unsealing direction in the third line of weakness and proceeding towards the first line of weakness or second line of weakness can be reliably trapped in the region of its formation. This makes it possible to more reliably prevent an unsealing line from proceeding further outwards, due to the force acting on the portion along the first line of weakness or second line of weakness on unsealing, without being trapped in the region of formation of the first line of weakness or second line of weakness. Also, it is possible to more reliably ensure that the direction of advance of the unsealing line is again converted in direction into the desired unsealing direction in the region of formation of the first line of weakness or second line of weakness.

Furthermore, in a bag for packaging according to the present invention, preferably the first line of weakness and the second line weakness are respectively constituted by a plurality of breaks of perforation form having an inclination with respect to a prescribed unsealing direction; the plurality of breaks of perforation form constituting the first line of weakness formed in the first face and the plurality of breaks of perforation form constituting the third line of weakness formed in the first face being formed inclined in mutually opposite directions with respect to the prescribed unsealing direction; the plurality of breaks of perforation form constituting the first line of weakness formed in the second face and the plurality of breaks of perforation form constituting the third line of weakness formed in the second face being formed inclined in mutually opposite directions with respect to the prescribed unsealing direction; the plurality of breaks of perforation form constituting the second line of weakness formed in the first face and the plurality of breaks of perforation form constituting the third line of weakness formed in the first face being formed inclined in mutually opposite directions with respect to the prescribed unsealing direction; and the plurality of breaks of perforation form constituting the second line of weakness formed in the second face and the plurality of breaks of perforation form constituting the third line of weakness formed in the second face being formed inclined in mutually opposite directions with respect to the prescribed unsealing direction.

In this way, on unsealing, an unsealing line advancing, deviating from the desired unsealing direction in the third line of weakness towards the first line of weakness or second line of weakness can be reliably trapped in the region of their formation. This makes it possible to more reliably prevent an unsealing line from proceeding further outwards, due to the force acting on the portion along the first line of weakness or second line of weakness on unsealing, without being trapped in the region of formation of the first line of weakness or second line of weakness. Also, it is possible to more reliably ensure that the direction of advance of the unsealing line is controlled such that it is again converted in direction into the desired unsealing direction in the region of formation of the first line of weakness or second line of weakness.

The condition that "the plurality of breaks of perforation form constituting the first line of weakness formed in the first face and the plurality of breaks of perforation form constituting the third line of weakness formed in the first face are formed inclined in mutually opposite directions with respect to the prescribed unsealing direction" indicates that, on the side of the first face, whereas the inclination of the breaks of the third line of weakness is formed such as to convert the direction of advance of the unsealing line that is produced on unsealing into a direction towards the first line of weakness, the inclination of the breaks of the first line of weakness is formed such as to convert the direction of advance of the unsealing line that has arrived at the region of formation of the first line of weakness again into the direction of the third line of weakness. Also, the condition that "the plurality of breaks of perforation form constituting the first line of weakness formed in the second face and the plurality of breaks of perforation form constituting the third line of weakness formed in the second face are formed inclined in mutually opposite directions with respect to the prescribed unsealing direction" means that, in the second face, the same condition as the relationship between the inclination of the breaks of the third line of weakness in the first face described above and the inclination of the first line of weakness is established.

Furthermore, the condition that "the plurality of breaks of perforation form constituting the second line of weakness formed in the first face and the plurality of breaks of perforation form constituting the third line of weakness formed in the first face are formed inclined in mutually opposite directions with respect to the prescribed unsealing direction" indicates that, on the side of the first face, whereas the inclination of the breaks of the third line of weakness is formed such as to convert the direction of advance of the unsealing line that is produced on unsealing into a direction towards the second line of weakness, the inclination of the breaks of the second line of weakness is formed such as to convert the direction of advance of the unsealing line that has arrived at the region of formation of the second line of weakness again into the direction of the third line of weakness. Also, the condition that "the plurality of breaks of perforation form constituting the second line of weakness formed in the second face and the plurality of breaks of perforation form constituting the third line of weakness formed in the second face are formed inclined in mutually opposite directions with respect to the prescribed unsealing direction" means that, in the second face, the same condition as the relationship between the inclination of the breaks of the third line of weakness in the first face described above and the inclination of the first line of weakness is established.

Also, preferably, the plurality of breaks in perforation form constituting the first line of weakness and the second line of weakness in the bag for packaging according to the present invention are respectively formed so as to have an inclination of 25 to 45° with respect to the prescribed unsealing direction. In this way, the direction of advance of the unsealing line advancing through the region of formation of the first line of weakness or the second line of weakness formed respectively in the first face and second face during unsealing can be converted in direction in a smoother fashion towards the desired unsealing direction. In the following description, the inclination respectively possessed by the plurality of breaks in perforation form of the first line of weakness and second line of weakness with respect to the desired unsealing direction will be described as the "inclination of the breaks of the first line of weakness" and the "inclination of the breaks of the second line of weakness".

Furthermore, preferably a bag for packaging according to the present invention is further provided with a notch for unsealing formed at the end of the third line of weakness. Using this notch, the unsealing operation can be initiated more smoothly. Also, thanks to this notch, unsealing can be achieved by tearing the bag for packaging utilizing the location of the region of formation of the lines of weakness in a reliable fashion instead of tearing some other location other than the region of formation of the lines of weakness of the bag for packaging.

Also, preferably, a bag for packaging according to the present invention is further provided with unsealing means for sealing the unsealed aperture after unsealing. In this way, even after unsealing, the unsealed aperture can again be fully closed, so that unused packaged articles can be kept in a sealed condition. "Sealing means" as referred to here indicates a member for sealing the unsealed aperture such as a plastic fastener.

Furthermore, preferably a bag for packaging according to the present invention is formed of composite packaging material comprising at least one sealing layer that holds the article for packaging in a stable gas-tight condition and at least one layer having a first line of weakness, second line of weakness and third line of weakness. By employing a composite packaging material having a laminated structure, the strength of the bag for packaging can be increased and the material properties of each layer can be selected in accordance with the conditions for storing the packaged article within the bag.

Also, thanks to the sealing layer, the packaged article can be kept in the desired sealed storage condition prior to unsealing. This is particularly beneficial in the case where, as the packaged articles, articles containing volatile constituents such as medical or pharmaceutical products or foods, articles whose quality depends greatly on moisture content, or articles in which deterioration of quality easily occurs due to oxidative reaction with the oxygen in the air are selected.

As used herein, "sealing layer" denotes a layer of material properties capable of storing packaged articles in gas-tight condition; more preferably, it denotes a layer having a surface that is chemically stable with respect to the packaged article or that has been subjected to chemically stabilizing surface processing, a layer that has scarcely any adsorption or permeability in respect of the constituents of the packaged article, a layer that has scarcely any permeability with respect to the constituents of the external air or moisture and a layer that is capable of holding in a stable fashion the packaged article in practically its initial condition by preventing denaturing/deterioration of the packaged article.

Preferably the sealing layer of the bag for packaging according to the present invention is an aluminum layer. Aluminum foil is suitable as a sealing layer since it has excellent gas-tightness and is chemically stable due to its surface oxide film yet is of light weight and easy to unseal. In particular, in the case of pap materials etc containing large amounts of volatile constituents, it is desirable to employ, as a material in sheet form, aluminum foil or material of gas barrier characteristics which is incapable of allowing permeation of the volatile constituents thereof, acrylonitrile film, which is incapable of absorbing volatile constituents, or a laminated material in which these are included in the layer structure.

In the following description, when the first line of weakness, second line of weakness or third line of weakness are respectively formed as assemblies of a plurality of lines of weakness, when describing their respective separations the following definitions will be adopted.

Specifically, the separation between the border of the first line of weakness on the side of the second line of weakness and the border of the second line of weakness on the side of the first line of weakness denotes the separation of the line formed in the position closest to the second line of weakness, of the lines of weakness constituting the first line of weakness and the line that is formed in the position closest to the first line of weakness, of the lines of weakness constituting the second line of weakness; this will be referred to as the "separation of the first line of weakness and second line of weakness".

Also, the separation between the border of the first line of weakness on the side of the third line of weakness and the border of the third line of weakness on the side of the first line of weakness denotes the separation of the line formed in the position closest to the third line of weakness, of the lines of weakness constituting the first line of weakness and the line that is formed in the position closest to the first line of weakness, of the lines of weakness constituting the third line of weakness; this will be referred to as the "separation of the first line of weakness and third line of weakness".

Furthermore, the separation between the border of the second line of weakness on the side of the third line of weakness and the border of the third line of weakness on the side of the second line of weakness denotes the separation of the line formed in the position closest to the third line of weakness, of the lines of weakness constituting the second line of weakness and the line that is formed in the position closest to the second line of weakness, of the lines of weakness constituting the third line of weakness; this will be referred to as the "separation of the second line of weakness and third line of weakness".

BEST MODES FOR CARRYING OUT THE INVENTION

Figure 1:
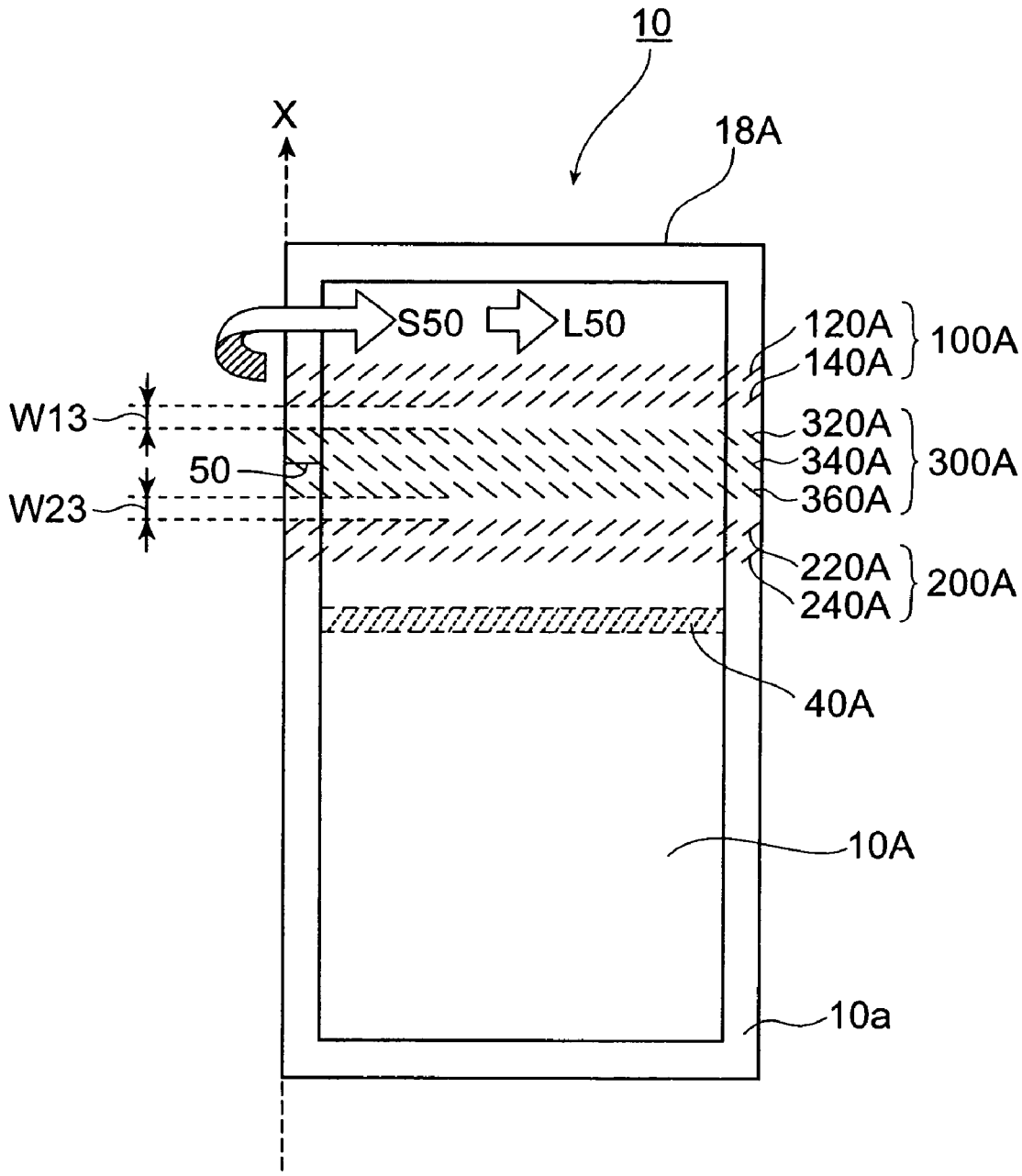
FIG. 1 is a front view illustrating a preferred embodiment of a bag for packaging according to present invention.

A preferred embodiment of the present invention is described in further detail below with reference to the drawings. In the drawings, identical or similar portions are given identical reference symbols and the bag for packaging and portions thereof in the drawing are shown with the side where the unsealing aperture is formed uppermost in all cases.

Figure 2:
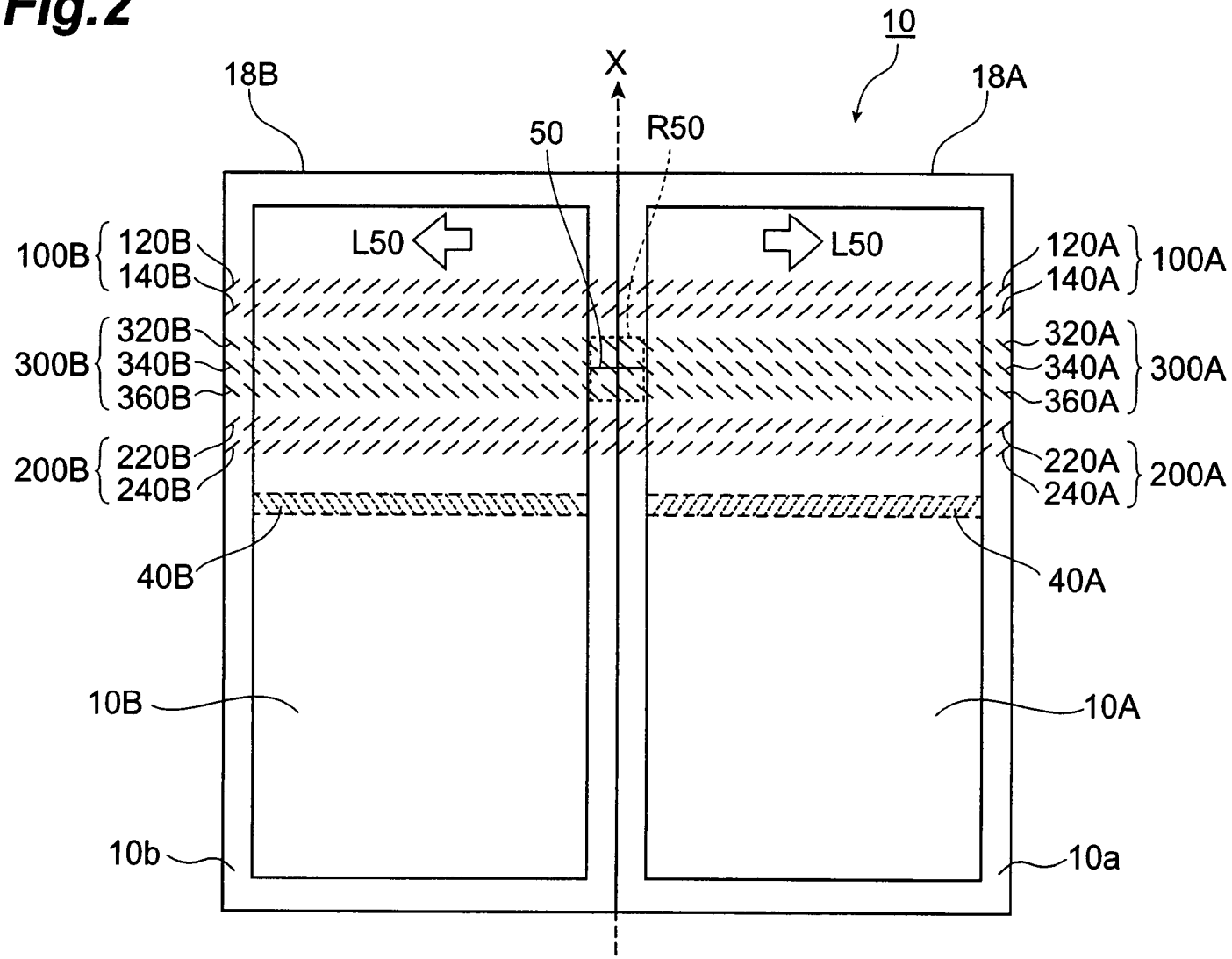
FIG. 2 is an opened-out view of the bag for packaging shown in FIG. 1.
Figure 3:
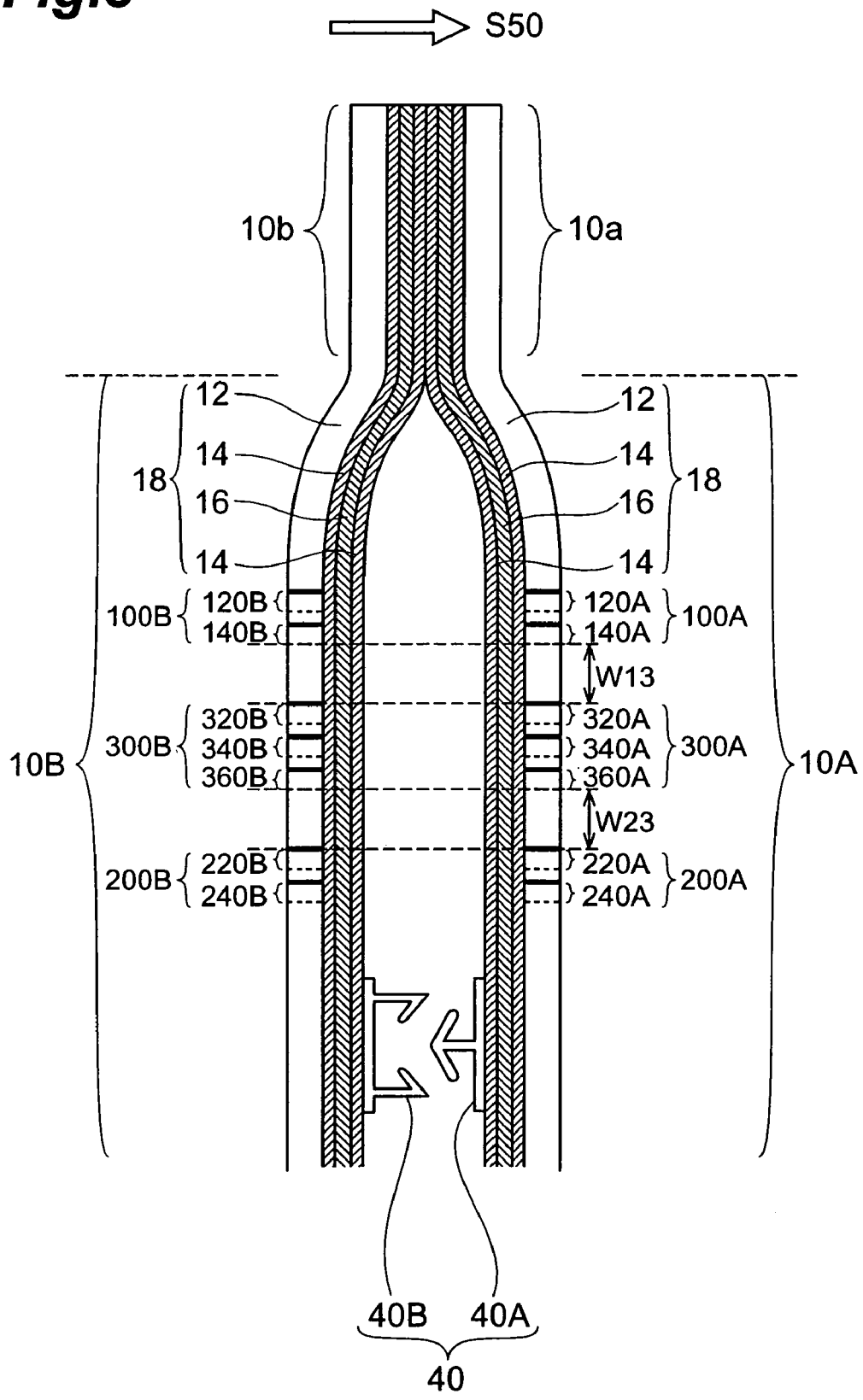
FIG. 3 is a diagrammatic cross-sectional view to a larger scale of the bag for packaging shown in FIG. 1.
Figure 4:
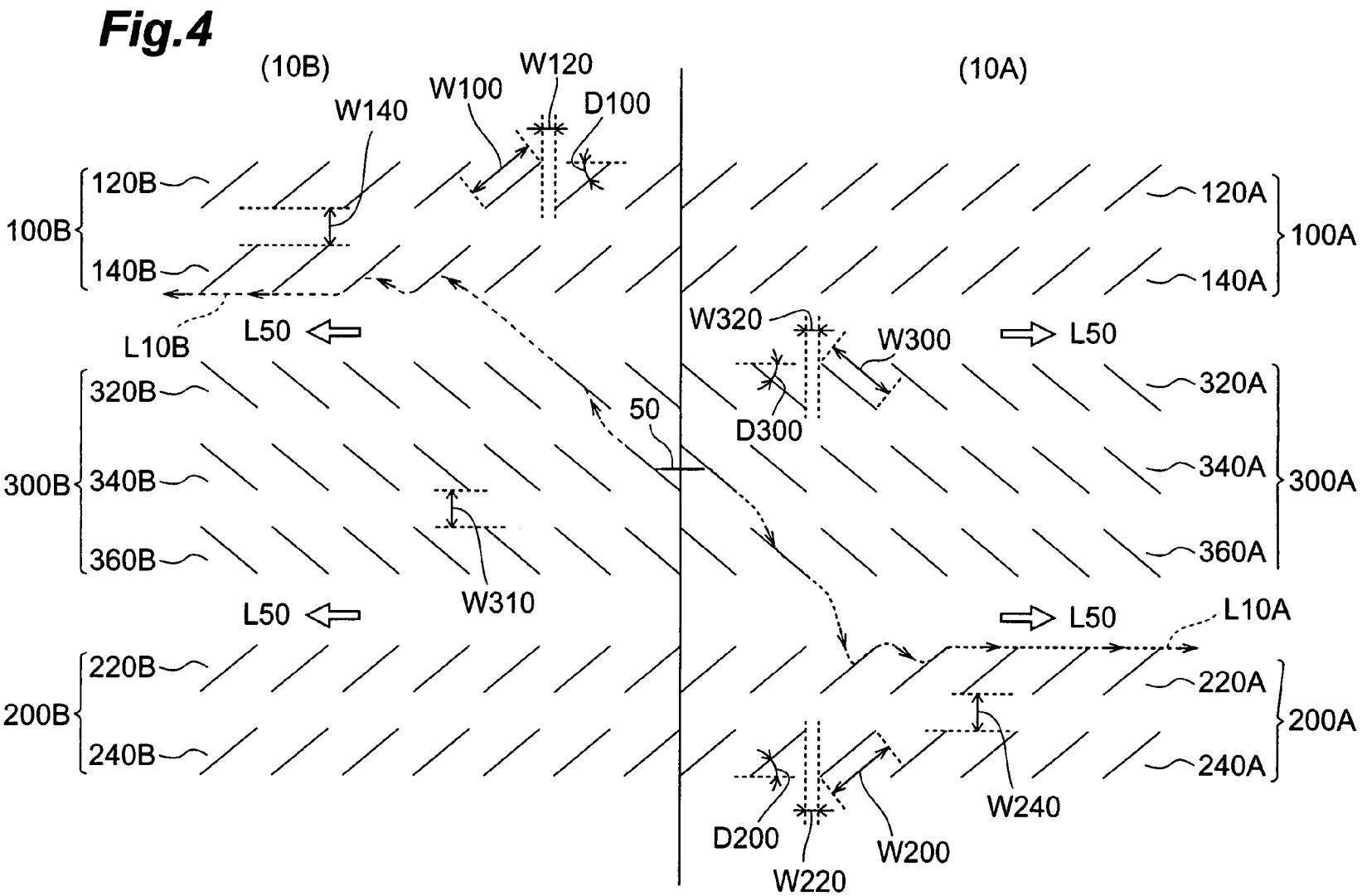
FIG. 4 is a diagram illustrating an actual unsealing line formed in a region between a first line of weakness and a second line of weakness when unsealing the bag for packaging shown in FIG. 1.

FIG. 1 is a front view of a bag for packaging according to a preferred embodiment of the present invention; FIG. 2 is an opened-out view of the bag for packaging of FIG. 1 seen from the outside face; FIG. 3 is a diagrammatic cross-sectional view to a larger scale of the bag for packaging of FIG. 1; and FIG. 4 is a diagram illustrating an actual unsealing line formed in a region between a first line of weakness and a second line of weakness when unsealing the bag for packaging of FIG. 1. In FIG. 1 to FIG. 3, for convenience in description, the locations where the lines of weakness are formed at the upper part of the bag for packaging are shown more heavily emphasized that the portions in the lower part of the bag for packaging, where the article to be packaged is accommodated.

As shown in FIG. 1 and FIG. 2, with the bag for packaging 10 of this embodiment, a type of sealing in four directions is provided wherein sealing is effected by pressure processing etc of respective outer borders after overlaying two sheets of composite packaging material and 18A and composite packaging material 18B of rectangular shape having a laminated structure.

Also, in the upper portion of first face 10A of this bag for packaging 10, there are formed in order from the top respectively a first line of weakness of 100A, a third line of weakness 300A and a second line of weakness 200A for unsealing, parallel with the short side direction of first face 10A. Also, a first line of weakness 100B, third line of weakness 300B and second line of weakness 200B are respectively also formed in second face 10B in order from the top for unsealing purposes.

As shown in FIG. 2, the first line of weakness 100A formed on the first face 10A and the first line of weakness 100B formed on the second face 10B are both formed in positions at the same distance from the top edge of rectangular bag 10 for packaging. Furthermore, the relative positional relationship of the second line of weakness 200A formed on the first face 10A and the second line of weakness 200B formed on the second face 10B and the relative positional relationship of the third line of weakness 300A formed on the first face 10A and the third line of weakness 300B formed on the second face 10B are the same as that of the first line of weakness 100A and first line of weakness 100B.

Furthermore, the third line of weakness 300A formed on the first face is an assembly of three lines of weakness 320A, 340A, 360A formed respectively parallel from the top, these lines of weakness 320A, 340A, 360A being constituted of a plurality of breaks in the form of perforations respectively having a prescribed inclination with respect to the desired unsealing direction L50. Likewise, the third line of weakness 300B of the second face is an assembly of three lines of weakness 320B, 340B, 360B formed respectively parallel from the top of, these lines of weakness 320B, 340B, 360B being constituted of a plurality of breaks in the form of perforations respectively having a prescribed inclination with respect to the desired unsealing direction L50.

Also, as shown in FIG. 4, in the bag 10 for packaging according to this embodiment, the plurality of breaks of perforation form constituting the lines of weakness of third line of weakness 300A of first face 10A and third line of weakness 300B on second face 10B have prescribed angles of the inclination D300 with respect to the desired unsealing direction L50.

Also, in the case of this bag 10 for packaging, the inclinations possessed by the plurality of breaks of perforation form constituting the lines of weakness of third line of weakness 300A of first face 10A and third line of weakness 300B of second face 10B with respect to the desired unsealing direction L50 are set as follows.

Specifically, as shown in FIG. 4, in the first face 10A, the inclination of the breaks of the line of weakness of the third line of weakness 300A is an inclination starting out from a notch 50 constituting a starting point for unsealing within the region of formation of third line of weakness 300A that follows a direction making a downwards angle with respect to unsealing line L10A that proceeds parallel with the desired unsealing direction L50 i.e. an inclination that follows the direction whereby unsealing line L10A deviates towards second line of weakness 200A. Also, in the second face 10B, the inclination of the breaks of the line of weakness of the third line of weakness 300B is an inclination constituting a starting point for unsealing that follows a direction making an upwards angle with respect to unsealing line L10B that proceeds parallel with the desired unsealing direction L50 through the region of formation of third line of weakness 300B i.e. an inclination that follows the direction whereby unsealing line L10B deviates towards first line of weakness 100B.

Furthermore, as shown in FIG. 1 and FIG. 2, first line of weakness 100A of first face 10A is an assembly of two lines of weakness 120A, 140A formed respectively parallel from the top, these lines of weakness 120A, 140A being constituted of a plurality of breaks of perforation form having a prescribed inclination with respect to the respective desired unsealing direction L50. Thus, the angle of inclination of the breaks of these lines of weakness 120A, 140A is formed inclined in the opposite direction to the inclination of the breaks of the third line of weakness 300A formed on the first face with respect to prescribed unsealing direction L50. Likewise, the first line of weakness 100B of the second face 10B is an assembly of two lines of weakness 120B, 140B formed respectively parallel from the top, these lines of weakness 120B, 140B being constituted of a plurality of breaks of perforation form having a prescribed inclination with respect to the respective desired unsealing direction L50. Thus, the angle of inclination of the breaks of these lines of weakness 120B, 140B is formed inclined in the opposite direction to the inclination of the breaks of the third line of weakness 300B formed on the second face 10B with respect to prescribed unsealing direction L50.

Also, as shown in FIG. 4, the plurality of breaks in perforation form constituting the lines of weakness of first line of weakness 100A on first face 10A and first line of weakness 100B on second face 10B have prescribed inclination D100 with respect to the desired unsealing direction L50.

It should be noted that, in the case of this bag 10 for packaging, the inclination possessed by the plurality of breaks in perforation form constituting the lines of weakness of first line of weakness 100A on first face 10A and first line of weakness 100B on second face 10B with respect to the desired unsealing direction L50 is set as follows.

Specifically, as shown in FIG. 4, in the second face 10B, the inclination of the breaks of the first line of weakness 100B is an inclination that follows the direction making a downwards angle of unsealing line L10B with respect to the desired unsealing direction L50 i.e. is an inclination whereby the direction of advance of unsealing line L10B advancing towards the first line of weakness 100B deviating from the desired unsealing direction L50 by the inclination of the breaks of third line of weakness 300B described above is again converted in direction towards third line of weakness 300B. The direction of the advance of the actual unsealing line L10B after conversion of direction at first line of weakness 100B thus becomes parallel with the desired unsealing direction L50, by a balancing of the directions of the forces acting on the breaks constituting the lines of weakness of first line of weakness 100B during unsealing. Furthermore, in this bag 10 for packaging, unsealing line L10A does not advance from the third line of weakness 300A during actual unsealing at first line of weakness 100A in first face 10A, due to the set conditions of inclination of the third line of weakness 300A described above, but the inclination of the breaks of the first line of weakness 100A has an inclination that follows a direction with an upwards angle with respect to the desired unsealing direction L50. That is, as shown in FIG. 4, the inclination of the breaks of the first line of weakness 100A of the first face 10A is parallel with the inclination of the breaks of the first line of weakness 100B of the second face 10B when bag 10 for packaging is displayed in an opened-out view.

Furthermore, the second line of weakness 200A of first face 10A is an assembly formed by two lines of weakness 220A, 240A respectively parallel from the top; these lines of weakness 220A, 240A are constituted of a plurality of breaks in perforation form having a prescribed inclination with respect to the desired unsealing direction L50, respectively. Moreover, the inclination of the breaks of these lines of weakness 220A, 240A is formed with inclination in the opposite direction to the inclination of the breaks of the third line of weakness 300A formed in the first face with respect to the desired unsealing direction L50. Likewise, the second line of weakness 200B of second face 10B is an assembly formed by two lines of weakness 220B, 240B respectively parallel from the top; these lines of weakness 220B, 240B are constituted of a plurality of breaks in perforation form having a prescribed inclination with respect to the desired unsealing direction L50, respectively. Moreover, the inclination of the breaks of these lines of weakness 220B, 240B is formed with inclination in the opposite direction to the inclination of the breaks of the third line of weakness 300B formed in the second face 10B with respect to the desired unsealing direction L50.

Also, as shown in FIG. 4, the plurality of breaks in perforation form constituting the lines of weakness of second line of weakness 200A on first face 10A and second line of weakness 200B on second face 10B have prescribed inclination D200 with respect to the desired unsealing direction L50.

It should be noted that, in the case of this bag 10 for packaging, the inclination possessed by the plurality of breaks in perforation form constituting the lines of weakness of second line of weakness 200A on first face 10A and second line of weakness 200B on second face 10B with respect to the desired unsealing direction L50 is set as follows.

Specifically, as shown in FIG. 4, in the first face 10A, the inclination of the breaks of the second line of weakness 200B is an inclination that follows the direction making an upwards angle of unsealing line L10A with respect to the desired unsealing direction L50 i.e. is an inclination whereby the direction of advance of unsealing line L10A advancing towards the second line of weakness 200A deviating from the desired unsealing direction L50 by the inclination of the breaks of third line of weakness 300A described above is again converted in direction towards third line of weakness 300A. The direction of the advance of the actual unsealing line L10A after conversion of direction at second line of weakness 200A thus becomes parallel with the desired unsealing direction L50, by a balancing of the directions of the forces acting on the breaks constituting the lines of weakness of second line of weakness 200A during unsealing. Furthermore, in this bag 10 for packaging, unsealing line L10B does not advance from the third line of weakness 300B during actual unsealing at second line of weakness 200B in second face 10B, due to the set conditions of inclination of the third line of weakness 300B described above, but the inclination of the breaks of the second line of weakness 200B has an inclination that follows a direction with an upwards angle with respect to the desired unsealing direction L50. That is, as shown in FIG. 4, the inclination of the breaks of the second line of weakness 200B of the second face 10B is parallel with the inclination of the breaks of the second line of weakness 200A of the first face 10A when bag 10 for packaging is displayed in an opened-out view.

In addition, a notch 50 for starting the unsealing operation in a smooth fashion is formed at the ends of line of weakness 340A constituting the third line of weakness 300A of first face 10A and line of weakness 340B constituting third line of weakness 300B of second face 10B, so as to pass through from the first face 10A to the second face 10B.

Furthermore, within bag 10 for packaging, a plastic faster 40 (sealing means) for opening and closing the unsealed aperture produced after unsealing is provided parallel with the second line of weakness 200A of the first face 10A and the second line of weakness 200B of the second face 10B and below these.

The various structural elements will now be described in detail with reference to FIG. 1 to FIG. 6.

Figure 5:
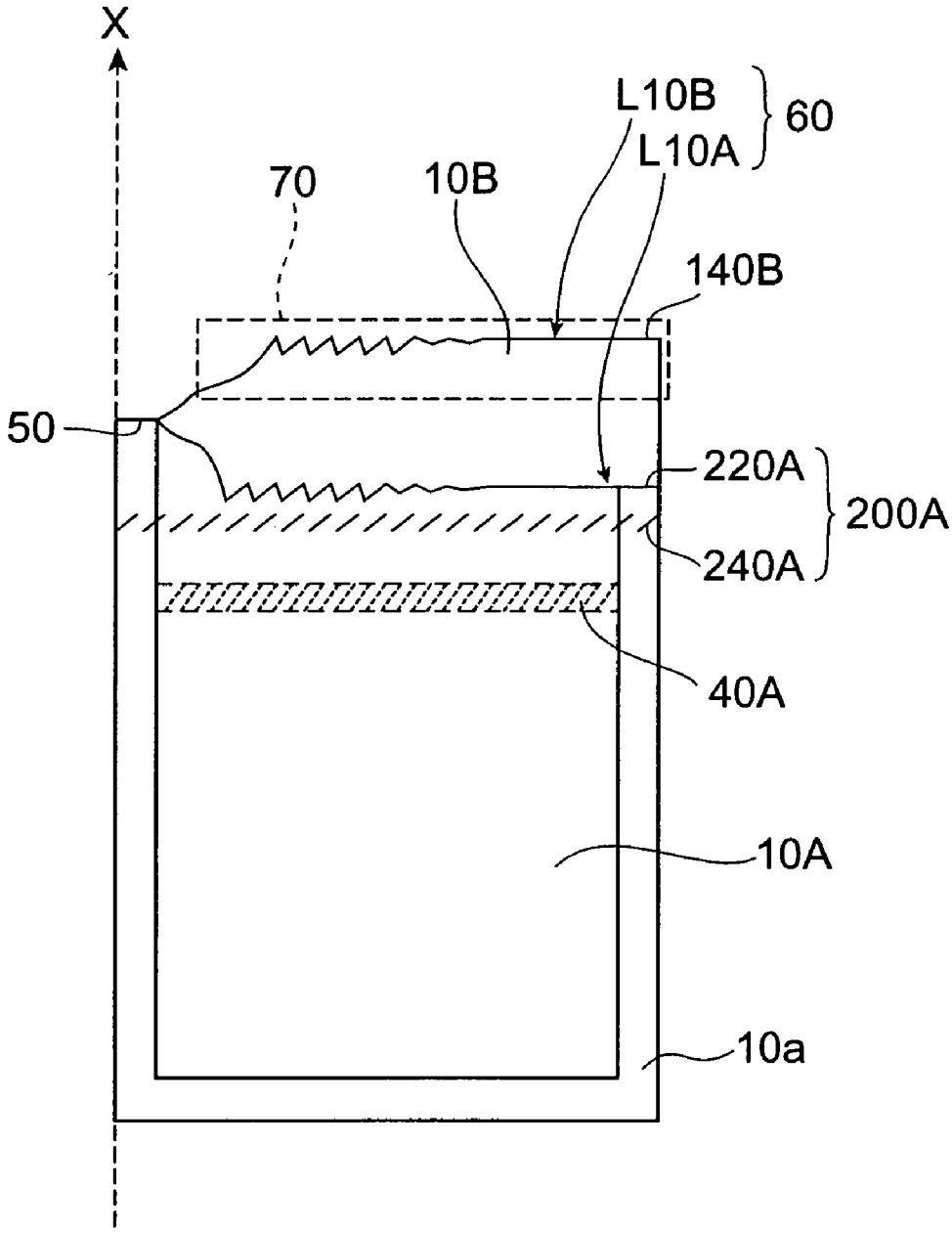
FIG. 5 is a front view showing the condition after unsealing of the bag for packaging shown in FIG. 1.
Figure 6:
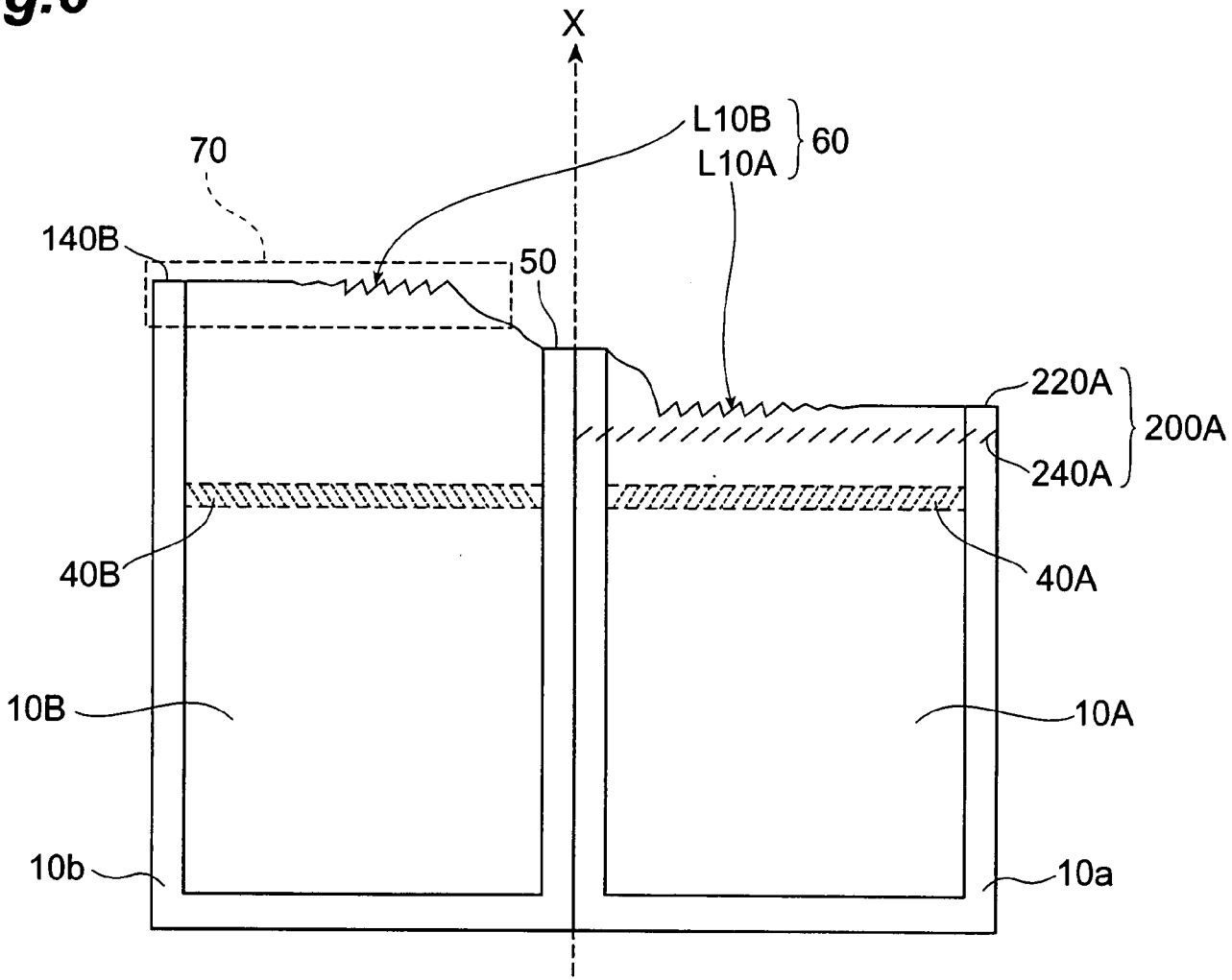
FIG. 6 is an opened-out view of the bag for packaging after unsealing shown in FIG. 5.

FIG. 5 is a front view showing the condition after unsealing of the bag for packaging shown in FIG. 1; FIG. 6 is an opened-out view of the bag for packaging after unsealing shown in FIG. 5.

For the composite packaging member 18 that forms bag 10 for packaging, as shown in FIG. 3, composite laminated film 18 is employed having a 4-layer structure in which there are laminated paper 12 as a layer where the lines of weakness are formed from the outside in the direction of the inside, plastic film 14 constituting a sealing layer, in which no lines of weakness are formed, aluminum foil 16, and plastic film 14. As mentioned previously, aluminum foil is preferably employed as one of the sealing layers on account of its light weight, ease of sealing, gas-tightness and excellent chemical stability. This composite laminated film 18 can be manufactured using known manufacturing methods such as a dry lamination method, wet lamination method, hot melt lamination method, or extrusion lamination method etc. If the breaks of the lines of weakness are formed having a slight thickness so that they do not penetrate through the layer where the lines of weakness of formed, lines of weakness may also be formed in the sealing layers.

Also, there is no particular restriction regarding the constituent materials of the layers of this composite packaging material 18 and, irrespective of how the lines of weakness are formed, a suitable selection may be made from paper, non-woven fabric, aluminum, cellophane, nylon, polyester, polypropylene, polyvinyl chloride, polyamide, polyacrylonitrile, olefins, polyvinylidene chloride, polyvinyl alcohol, ethylene acetic acid vinyl copolymer, polycarbonate, polystyrene, ethylene vinyl alcohol copolymer or ethylene acrylate copolymer. Materials to which printing ink or adhesive etc has been applied, or materials provided with a thin film by a method such as evaporation or spluttering may be employed. As thin films, apart from metals such as aluminum, thin films of high transparency and gas barrier characteristics are suitable, such as silicon oxide, magnesium oxide or aluminum oxide. Whatever the case, materials having sufficient flexibility when used in the form of a bag for packaging are desirable as sheet-form structural materials.

As shown in FIG. 2 and FIG. 3, the first line of weakness 100A and third line of weakness 300A on first face 10A and the first line of weakness 100B and third line of weakness 300B on the second face 10B are arranged to be mutually parallel, having a respective prescribed separation W13. Also, the second line of weakness 200A and third line of weakness 300A on the first face 10A and the second line of weakness 200B and third line of weakness 300B on the second face 10B are arranged to be mutually parallel, having a respective prescribed separation W23. Furthermore, as shown in FIG. 3, on both the first face 10A and second face 10B, the breaks of the lines of weakness are formed only in the paper 12 constituting the outermost layer of the composite packaging material 18.

The separation W13 of first line of weakness 100A and third line of weakness 300A on first face 10A (or first line of weakness 100B and third line of weakness 300B on second face 10B) indicates the distance of the line of weakness 140A formed at the position closest to third line of weakness 300A in first line of weakness 100A and line of weakness 320A formed in the position close to first line of weakness 100A in third line of weakness 300A (or the distance of line of weakness 140B formed in the position closest to third line of weakness 300B in first line of weakness 100B on second face 10B and the line of weakness 320B formed in the position closest to first line of weakness 100B in third line of weakness 300B).

During unsealing, the actual unsealing lines are respectively formed in the region between first line of weakness 100A and second line of weakness 200A in the first face 10A and in the region between first line of weakness 100B and second line of weakness 200B in the second face 10B, thereby forming the unsealing aperture.

As described below, unsealing line L10A and unsealing line L10B are formed during unsealing by respective arrangement of the lines of weakness of the first face 10A and second face 10B as described above. First of all, as described above with reference to FIG. 4, by force applied to third line of weakness 300A during unsealing, the unsealing line L10A advances towards second line of weakness 200A with the inclination of the plurality of breaks in the form of perforations. Also, in the same way, unsealing line L10B advances towards first line of weakness 100B by the force applied to third line of weakness 300B during unsealing. Next, unsealing line L10A, having reached the region of formation of second line of weakness 200A, advances with its direction of advance converted into the desired unsealing direction L50 in accordance with the inclination of the plurality of breaks in the form of perforations constituting the lines of weakness of the second line of weakness 200A. Concurrently with this, the unsealing line L10B that has reached the region of formation of first line of weakness 100B advances with its direction converted into the desired unsealing direction L50 in the same way.

At this point, if for example in the first face 10A, first of all the direction of the advance of unsealing line L10A tries to run from the third line of weakness 300A towards the second line of weakness 200A utilizing the inclination of the breaks of the third line of weakness 300A, depending on the manner in which the force is applied during unsealing, even if the direction of advance of unsealing line L10A is not properly directed from third line of weakness 300A to second line of weakness 200A by the first break, but unsealing line L10A continues to advance parallel with the unsealing direction L50 without deviation, since breaks in the same rank as the direction of advance, or fresh breaks downstream thereof are lying in wait in a continuous arrangement, ultimately unsealing line L10A will reliably be made to advance from the third line of weakness 300A towards the second line of weakness 200A (see the unsealing line L10A in FIG. 4).

Also, even if the unsealing line L10A after having reached second line of weakness 200A is unable to be properly converted in direction of advance into the desired unsealing direction L50 at the first break, due to the manner in which force is applied during unsealing, and so continues to advance further downwards through the region where the second line of weakness 200A is formed, since breaks in the same rank, or fresh breaks downstream thereof are lying in wait in a continuous arrangement, ultimately the direction of advance of the unsealing line L10A will be reliably corrected to become parallel with the unsealing direction L50 and so will advance without deviating greatly from this direction (see unsealing line L10A in FIG. 4).

Likewise, in second face 10B, the direction of advance of unsealing line L10B is also controlled by third line of weakness 300B and first line of weakness 100B so that its direction of advance is reliably corrected to be parallel with unsealing direction L50 and thus advances with little deviation from this direction (see unsealing line L10B in FIG. 4). Thus, in both the first face 10A and second face 10B, tearing of bag 10 for packaging along unsealing line L10A and unsealing line L10B ultimately proceeds in a controlled fashion parallel with the desired unsealing direction L50.

As a result, as shown in FIG. 5 and FIG. 6, at the unsealed aperture 60 after unsealing of bag 10 for packaging, a border portion 70 along unsealing line L10B projects with respect to unsealing line L10A and this projecting portion provides a finger-grip portion 70 of unsealing aperture 60.

In the unsealing operation, in order to ensure a sufficient finger-grip portion 70 by ideal functioning of the first line of weakness, second line of weakness and third line of weakness as described above, the number of lines of weakness respectively constituting the first line of weakness, second line of weakness and third line of weakness, the length W300 of the breaks in the third line of weakness shown in FIG. 4, the separation W320 between breaks of the third line of weakness, the separation W310 between the lines of weakness constituting the third line of weakness, the angle of inclination D300 of the breaks in the form of perforations of the third line of weakness with respect to the desired unsealing direction L50, the separation W13 between the first line of weakness and third line of weakness shown in FIG. 3, the separation W23 of the second line of weakness and the third line of weakness and the shapes of the breaks of the first line of weakness and second line of weakness are set taking into account the strength of the composite packaging material 18 that is employed.

Furthermore, where, as in this embodiment, as the breaks constituting the first line of weakness and second line of weakness, a plurality of breaks in the form of perforations are employed having an inclination with respect to the desired unsealing direction L50, in the same way as in the case of the third line of weakness, the length W100 of the breaks of the first line of weakness shown in FIG. 4, the separation W120 between the breaks of the first line of weakness, the separation W140 between the lines of weakness constituting the first line of weakness, the angle of inclination D100 of the breaks in the form of perforations of the first line of weakness with respect to the desired unsealing direction L50, the length W200 of the breaks of the second line of weakness, the separation W220 between the breaks of the second line of weakness, the separation W240 between the lines of weakness constituting the second line of weakness, and the angle of inclination D200 of the breaks in the form of perforations of the second line of weakness with respect to the desired unsealing direction L50 are set taking into account the strength of the composite packaging material 18 that is employed.

From this point of view, the number of lines of weakness constituting the third line of weakness is preferably respectively 1 to 10 and even more preferably 2 to 4. If the number of lines of weakness is more than 10, this is undesirable, since time is required for manufacture and, in addition, the portion of the bag for packaging that is torn away and discarded on unsealing becomes large.

Also, by providing a plurality of lines of weakness as described above that constitute the third line of weakness, the direction of advance of unsealing line L10A and unsealing line L10B produced on unsealing in the first face 10A and second face 10B can be more reliably directed to gradually deviate from the desired unsealing direction L50 to the second line of weakness 200A and first line of weakness 100B, making it possible for the unsealing operation to proceed in a more reliable fashion. In particular, if the number of lines of weakness constituting the third line of weakness is 2 to 4, a suitable region of formation of the third line of weakness can be ensured, so an ample finger-grip portion 70 is formed in bag 10 for packaging after unsealing and unsealing line L10A and unsealing line L10B are formed in a regular horizontal fashion without raggedness, so the appearance of the unsealing aperture after unsealing tends to become more attractive.

Also, preferably, the angle of inclination D300 of the breaks of perforation form of the third line of weakness with respect to the desired unsealing direction L50 is 25 to 45°. In this way, a smoother deviation of the direction of advance of unsealing line L10A and unsealing line L10B from the desired unsealing direction L50 towards the direction of first line of weakness 100B or second line of weakness 200A on unsealing can be achieved.

In contrast, if the angle of inclination D300 is less than 25°, when the direction of advance of unsealing line L10A and unsealing line L10B is made to deviate from the desired unsealing direction L50 towards the direction of first line of weakness 100B or second line of weakness 200A, since the angle of inclination is small, the effective distance of the unsealing line before arrival at first line of weakness 100B or second line of weakness 200A becomes long. As a result, the size of the finger-grip portion 70 produced at unsealing aperture 60 of bag 10 for packaging after unsealing has a considerable tendency to become insufficient. On the other hand, if the aforesaid angle of inclination D300 exceeds 45°, when the direction of advance of unsealing line L10A and unsealing line L10B deviates from the desired unsealing direction L50 towards the direction of first line of weakness 100B or second line of weakness 200A, since the angle of inclination is large, the force that is applied to a single break of the line of weakness during unsealing becomes large, resulting in unsealing line L10A and unsealing line L10B tended to become ragged or split. The result is to increase the tendency for the appearance of unsealing aperture 60 and finger-grip portion 70 of the bag 10 for packaging after unsealing to be adversely affected.

Furthermore, the number of lines of weakness constituting the first line of weakness and the second line of weakness is preferably 1 to 10 and more preferably 2 to 4. If the number of lines of weakness is more than 10, this is undesirable, since time is required for manufacture and, in addition, the portion of the bag for packaging that is torn away and discarded on unsealing becomes large.

Also, by providing a plurality of lines of weakness to constitute the first line of weakness and second line of weakness as described above, on unsealing, an unsealing line that advances, deviating from the desired unsealing direction L50 towards the first line of weakness or second line of weakness is more reliably trapped in the region of formation of this first line of weakness or second line of weakness instead of advancing further to the outside and it is then possible to more reliably again convert the direction of advance of the unsealing line into the desired unsealing direction L50. In particular, if the number of lines of weakness constituting the first line of weakness and the second line of weakness is 2 to 4, an ample finger-grip portion 70 is formed on the bag 10 for packaging after unsealing and unsealing line L10A and unsealing line L10B are formed in a regular horizontal fashion without raggedness, so the appearance of the unsealing aperture after unsealing tends to become more attractive.

Also, preferably, the angle of inclination D100 of the breaks of perforation form of the first line of weakness with respect to the desired unsealing direction L50 is 25 to 45°.

In this way, a smoother conversion of the direction of advance of unsealing line L10B that advances through the region of formation of first line of weakness 100B on unsealing towards the desired unsealing direction L50 can be achieved. It should be noted that, even if the inclination of the first lines of weakness and third lines of weakness formed in first face 10A and the second face 10B are set to be the opposite of this embodiment, the same beneficial effect can be obtained between the unsealing line L10A and first line of weakness 100A in first face 10A.

In contrast, if the angle of inclination D100 is less than 25°, when the direction of advance of unsealing line L10B that advances from the third line of weakness 300B towards the first line of weakness 100B is converted in direction to the desired unsealing direction L50, since the angle of inclination is small, the effective distance of the unsealing line before it becomes parallel with the desired unsealing direction L50 becomes long. As a result, the size of the finger-grip portion 70 produced at unsealing aperture 60 of bag 10 for packaging after unsealing has a considerable tendency to become insufficient. On the other hand, if the aforesaid angle of inclination D100 exceeds 45°, when the direction of advance of unsealing line L10B that advances from the third line of weakness 300B of the second face 10B towards the first line of weakness 100B is converted in direction to the desired unsealing direction L50, since the angle of inclination is large, the force that is applied to a single break of the line of weakness during unsealing becomes large, resulting in unsealing line L10A after unsealing tending to become very ragged or large unnecessary tears to be produced instead of a neat horizontal line. The result is to increase the tendency for the inconveniences to be produced of the appearance of unsealing aperture 60 and finger-grip portion 70 of the bag 10 for packaging after unsealing being adversely affected or even though a finger-grip portion 70 is formed this being difficult to grip with the fingers owing to the presence of unnecessary tears.

It may be expected that the same inconveniences would occur between the unsealing line L10A and first line of weakness 100A in the first face 10A also in the case where the inclination of the first lines of weakness and third lines of weakness formed in first face 10A and second face 10B is set oppositely to that of the present embodiment, if the angle of inclination D100 is less than 25° or if the angle of inclination D100 exceeds 45°.

It is also preferable that the angle of inclination D200 of the breaks in perforation form of the second line of weakness with respect to the desired unsealing direction L50 should be 25 to 45°. In this way, the direction of advance of unsealing line L10A can be more smoothly converted in direction towards the desired unsealing direction L50 on unsealing. The same beneficial effect between the unsealing line L10B and the second line of weakness 200B can be obtained in the second face 10B even if the inclination of the second lines of weakness and third lines of weakness formed in the first face 10A and second face 10B are set oppositely to that of the present embodiment.

In contrast, if the above angle of inclination D200 is less than 25°, when the direction of advance of unsealing line L10A that advances from third line of weakness 300A towards second line of weakness 200A is converted in direction to the desired unsealing direction L50, since the angle of inclination is small, the effective distance of the unsealing line before it becomes parallel with the desired unsealing direction L50 becomes long. As a result, there is a considerable tendency for the size of the finger-grip portion 70 that is produced at unsealing aperture 60 of bag 10 for packaging after unsealing to be insufficient. On the other hand, if the aforesaid angle of inclination D200 exceeds 45°, when the direction of advance of unsealing line L10A that advances from the third line of weakness 300A towards the second line of weakness 200A is converted in direction to the desired unsealing direction L50, since the angle of inclination is large, the force that is applied to a single break of the line of weakness during unsealing becomes large, resulting in unsealing line L10A after unsealing tending to become very ragged or large unnecessary tears to be produced instead of a neat horizontal line. The result is to increase the tendency for the inconveniences to be produced of the appearance of unsealing aperture 60 and finger-grip portion 70 of the bag 10 for packaging after unsealing being adversely affected or even though a finger-grip portion 70 is formed this being difficult to grip with the fingers owing to the presence of unnecessary tears.

It may be expected that the same inconveniences would occur between the unsealing line L10B and second line of weakness 200B in the second face 10B also in the case where the inclination of the second lines of weakness and third lines of weakness formed in first face 10A and second face 10B is set oppositely to that of the present embodiment, if the angle of inclination D200 is less than 25° or if the angle of inclination D200 exceeds 45°.

Also, depending on the conditions of use, the separation W13 between the first line of weakness and third line of weakness and the separation W23 between the second line of weakness and the third line of weakness may be zero. By doing this, the space for formation of the first line of weakness, second line of weakness and third line of weakness may be made more compact.

Notch 50 constitutes the starting point for unsealing during unsealing. For this reason, it is important that it should be formed in a position where effective unsealing is possible, in other words a position where the third line of weakness 300A of the first face 10B and the third line of weakness 300B of the second face 10B that are formed corresponding to the desired unsealing direction L50 function effectively.

From this point of view, notch 50 is preferably formed in the region R50 of unsealing portion 10*a* and unsealing portion 10*b* including the end of third line of weakness 300A of first face 10A and the end of third line of weakness 300B of second face 10B as shown in FIG. 2 and is more preferably formed in a region R50 including the end of line of weakness 340A positioned in the middle of the lines of weakness constituting third line of weakness 300A and the end of line of weakness 340B positioned in the middle of the lines of weakness constituting third line of weakness 300B. This is because, if the notch 50 is formed in a location other than that described above, it becomes impossible for the unsealing lines L10A and L10B to advance utilizing the breaks in the form of perforations of third line of weakness 300A and third line of weakness 300B when unsealing is performed, with the result that their respective effective advance into the region of the first line of weakness 100B and second line of weakness 200A that are to be respectively formed becomes impossible.

In this embodiment, as shown in FIG. 4, notch 50 is formed by cutting the sealing portion 10*a* and sealing portion 10*b* of composite packaging material 18 up to the position where contact is made with line of weakness 340A constituting third line of weakness 300A and line of weakness 340B constituting third line of weakness 300B. By doing this, in the unsealing operation, unsealing can be commenced in a smooth fashion by utilizing the third line of weakness 300A and third line of weakness 300B. Also, the depth of this notch 50 is set so as to be smaller than the width of sealing portion 10*a* and sealing portion 10*b*, such that the tightly sealed condition of bag 10 for packaging prior to unsealing can be maintained. It should be noted that there is no particular restriction on the shape of this notch 50 and it could be for example a so-called I notch or V notch.

Also, in the bag 10 for packaging of this embodiment, the inclination of the breaks of third line of weakness 300A and third line of weakness 300B with respect of the desired unsealing direction L50 is set as shown in FIG. 2. Consequently, as shown in FIG. 5 and FIG. 6, the border portion 70 along unsealing line L10B that is produced on one or other of the lines of weakness (line of weakness 140B in FIG. 5 and FIG. 6) constituting first line of weakness 100B of second face 10B protrudes upwards beyond the unsealing line L10A that is produced on one or other of the lines of weakness (line of weakness 220A in FIG. 5 and FIG. 6) constituting second line of weakness 200A of first face 10A, thereby constituting finger-grip portion 70, which is employed for opening and closing unsealing aperture 60.

Also, although in FIG. 1 and FIG. 3 the direction S50 of commencement of unsealing was shown as a direction twisting in the direction of the first face 10A from second face 10B, in the bag 10 for packaging according to this embodiment, the direction S50 of commencement of unsealing could be the opposite direction; finger-grip portion 70 can be reliably formed at unsealing aperture 60 after unsealing whichever the direction in which twisting takes place.

In plastic fastener 40, as shown in FIG. 3, male portion 40A is arranged on plastic film layer 14 on the inside of first face 10A and female portion 40B is arranged on plastic film layer 14 on the inside of second face 20B opposite male portion 40A. By fitting together male portion 40A and female portion 40B of this plastic fastener 40, even after unsealing of bag 10 for packaging, unused packaged substance remaining in bag 10 for packaging can be maintained in a desired sealed condition.

Also, although there is no particular restriction on the packaged substance accommodated in the bag for packaging, it is particularly effective if a packaged substance is employed in respect of which unused quantities thereof are desired to be sealed and kept after unsealing and which unused quantities are desired to be easily extractable when required. For example it may be applied to packaged articles such as medical or pharmaceutical products, food products, cosmetic products, toiletries or envelopes, including shipping materials or taping materials.

The method of use of a bag 10 for packaging according to this embodiment illustrated in FIG. 1 will now be described with reference to FIG. 1 to FIG. 6.

First of all, as shown in FIG. 1 and FIG. 3, the location of bag 10 for packaging where the notch is formed is lightly gripped and unsealing is commenced by twisting in the direction of unsealing start direction $S_{50}$.

As shown in FIG. 4, when unsealing of bag 10 for packaging is commenced from notch 50, this is branched into unsealing line L10A towards first face 10A and unsealing line L10B towards second face 10B in accordance with the inclination of the breaks of third line of weakness 300A and third line of weakness 300B. After this, this unsealing line L10A and unsealing line L10B respectively advance towards second line of weakness 200A of first face 10A and first line of weakness 100B of second face 10B, by the force applied in order to effect unsealing.

After this, unsealing line L10A and unsealing line L10B that have respectively arrived at the location of formation of second line of weakness 200A of first face 10A and the location of formation of first line of weakness 100B of second face 10B are gradually controlled by the function of inclination of the breaks of second line of weakness 200A and first line of weakness 100B so as to become parallel with the direction of the desired unsealing direction L50, respectively, and soon reach the edge of bag 50 for packaging facing notch 50.

The user can therefore perform the operation of unsealing bag 10 for packaging in a smooth and neat fashion even without taking particular care. Also, by gripping with the fingers the finger-grip portion 70 formed at unsealing aperture 60 after unsealing, bag 10 for packaging can easily be opened and closed even after unsealing. For example, even users who are not skilful in performing delicate operations with the fingers such as elderly persons or children can perform the task of opening/closing bag 10 for packaging easily by gripping finger-grip portion 70. Also, thanks to the provision of plastic fastener 40, unused packaged articles can be kept in a tightly sealed condition without deterioration of quality.

Furthermore, since this bag 10 for packaging can be manufactured using two sheets of composite packaging material 18 formed with lines of weakness in the same pattern as shown in FIG. 2, it can be manufactured easily so productivity is extremely high.

Figure 7:
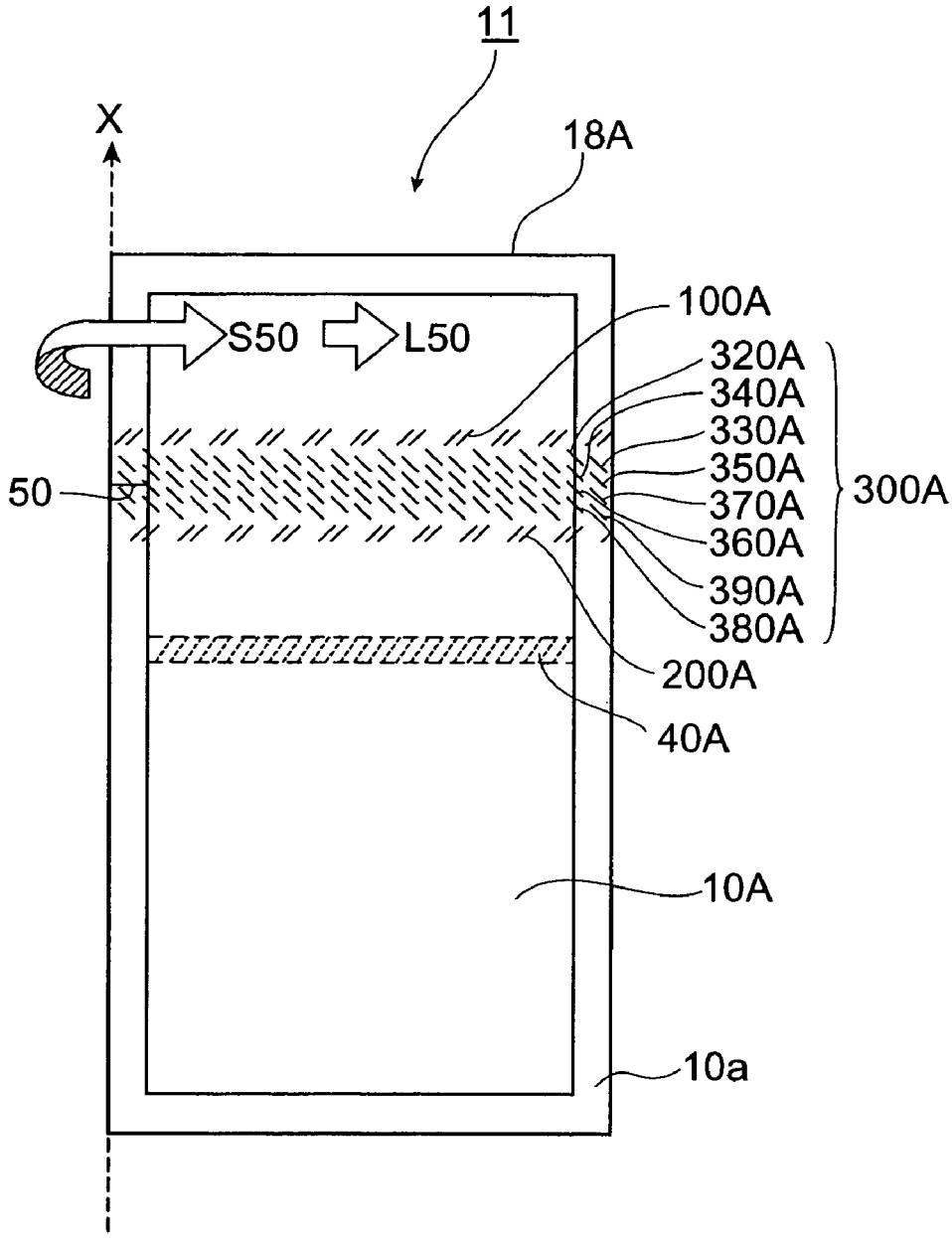
FIG. 7 is an opened-out view showing a second embodiment of a bag for packaging according to the present invention.
Figure 8:
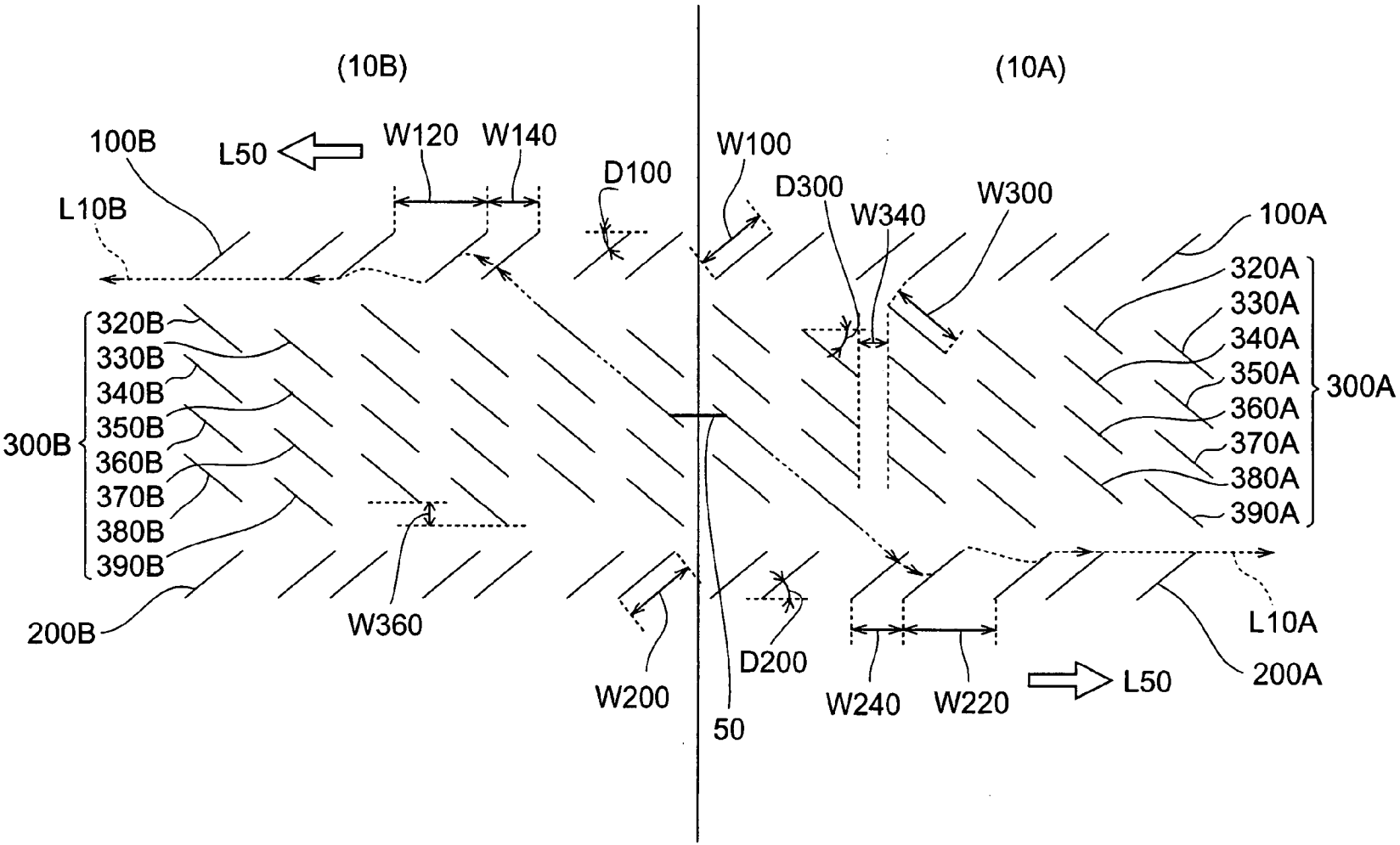
FIG. 8 is a diagram showing an actual unsealing line formed in the region between the first line of weakness and second line of weakness when unsealing the bag for packaging shown in FIG. 7.

FIG. 7 is a front view showing a second embodiment of a bag for packaging according to the present invention; FIG. 8 is a diagram showing an actual unsealing line formed in the region between the first line of weakness and second line of weakness when unsealing the bag for packaging of FIG. 7.

In the bag 11 for packaging shown in FIG. 7, the conditions of arrangement of the third line of weakness, first line of weakness and second line of weakness differ in the following respects with respect to the construction of the bag 10 for packaging shown in FIG. 1 to FIG. 3.

As shown in FIG. 8, the third line of weakness 300A formed on first face 10A of bag 11 for packaging comprises eight lines of weakness 320A, 330A, 340A, 350A, 360A, 370A, 380A, 390A having an angle of inclination D300 with respect to the desired unsealing direction L50. In the case of this bag 11 for packaging, unsealing line L10A is set so as to follow the direction of the lower second line of weakness 200A, by the inclination of the breaks in the form of perforations of the third line of weakness 300A.

Of the eight lines of weakness constituting these third lines of weakness 300A, a first group comprising the lines of weakness 320A, 340A, 360A and 380A and a second group comprising 330A, 350A, 370A and 390A are arranged having a prescribed separation W340 in the direction of the desired unsealing direction L50 and a prescribed separation 360 in the direction perpendicular to the desired unsealing direction L50.

The relative positional relationship of the breaks of the lines of weakness of the first group and the breaks of the lines of weakness of the second group is set such that when the breaks of the lines of weakness of the first group are linearly extended along this direction of inclination, they overlap with one or other of the breaks of the lines of weakness of the second group. For example, in FIG. 8, looking at the breaks of line of weakness 360A belonging to the first group of the third line of weakness 300A on first face 10A that is in contact with notch 50, when this break is linearly extended downwards along the direction of its inclination, it overlaps with a break of line of weakness 390A belonging to the second group. Thus, by setting the relative arrangement relationship of the breaks of the lines of weakness of the first group and the breaks of the lines of weakness of the second group, unsealing line L10A can be made to follow the lower second line of weakness 200A in a more reliable fashion.

Also, the breaks of the lines of weakness of the first group and the breaks of the lines of weakness of the second group are arranged in an offset condition having a prescribed separation W340 in the direction of the desired unsealing direction L50.

Consequently, even if, immediately after commencement of unsealing, instead of proceeding smoothly towards the lower second line of weakness 200A, unsealing line L10A proceeds for example along the desired unsealing direction L50 through the region of formation of the first group of third lines of weakness 300A, unsealing line L10A is reliably trapped by the breaks of the lines of weakness of the second group adjacent thereto along the unsealing direction or by the breaks of the lines of weakness of the first group further adjacent to this second group and its direction of advance is therefore converted in direction towards the lower second line of weakness 200A.

Thus, the angle of inclination D300 of the breaks of the lines of weakness, the width W300 of the breaks of the lines of weakness, and the prescribed separations W340 and W360 of the lines of weakness of the first group and the lines of weakness of the second group mentioned above are suitably adjusted with a view to making the unsealing line L10A more reliably follow the second line of weakness 200A and with a view to unsealing line L10A that has been made to proceed along the desired unsealing direction L50 through the region of formation of the first group of third lines of weakness 300A being more reliably trapped.

The third line of weakness 300B formed on second face 10B of the bag 11 for packaging comprises eight lines of weakness 320B, 330B, 340B, 350B, 360B, 370B, 380B and 390B having an angle of inclination D300 with respect to the desired unsealing direction L50. In the case of this bag 11 for packaging, unsealing line L10B is set so as to follow the direction of first line of weakness 100B by the inclination of the breaks of perforation form of third line of weakness 300B.

Of the eighth lines of weakness constituting this third line of weakness 300B, a first group comprising lines of weakness 320B, 340B, 360B, 380B and a second group comprising 330B, 350B, 370B and 390B are arranged so as to have a prescribed separation W340 in the direction of the desired unsealing direction L50 and a prescribed separation W360 in the direction perpendicular to the desired unsealing direction L50.

With the same aspects in view as in the case of unsealing line L10A described above, in this case also, angle of inclination D300 of the lines of weakness, width W300 of the breaks of the lines of weakness and prescribed separations W340 and W360 of the first group of lines of weakness and second group of lines of weakness described is above are suitably regulated.

Also, as shown in FIG. 8, first line of weakness 100A and second line of weakness 200A formed in first face 10A of bag 11 for packaging are formed having opposite inclinations D200 and D100 with respect to the inclination of the breaks of the third line of weakness as described above. Furthermore, first line of weakness 100A and second line of weakness 200A consist of a single line of weakness wherein a group of breaks constituted by two breaks is formed continuously. In the first face 10A of this bag 11 for packaging, what is actually utilized during unsealing is the second line of weakness 200A, by setting of the inclination of the breaks of the third line of weakness 300A as described above.

Second line of weakness 200A is arranged in a condition adjacent to third line of weakness 300A with practically no gap. Furthermore, if the breaks of third line of weakness 300A extend in straight lines along their direction of inclination with respect to third line of weakness 300A, these straight lines are arranged so as to cut across groups of breaks of second line of weakness 200A, each group of breaks consisting of two breaks of second line of weakness 200A. For example, in FIG. 8, looking at the break of line of weakness 360A belonging to the first group of third line of weakness 300A on first face 10A contacting notch 50, if this break is extended linearly downwards along its direction of inclination, it overlaps a break of the line of weakness 390A belonging to the second group. Furthermore, if the break of line of weakness 390A is extended in a straight line downwards along its direction of inclination, this straight line cuts across a group of breaks, two breaks constituting one group, of second line of weakness 200A.

By arranging such a second line of weakness 200A with respect to third line of weakness 300A, an unsealing line L10A that is conducted downwards from third line of weakness 300A is more reliably trapped and then can be converted in direction in a reliable fashion into the desired unsealing direction L50. It is also possible for second line of weakness 200A to be constituted solely by a single line of weakness; the space for forming the line of weakness can thereby be reduced.

The angle of inclination D200 of second line of weakness 200A, the width W200 of the breaks of second line of weakness 200A, the separation W220 between groups of breaks of second line of weakness 200A and the separation W240 between the two breaks constituting a group of breaks of second line of weakness 200A are suitably adjusted with a view to more reliable performance of trapping and conversion of direction of unsealing line L10A mentioned above, using second line of weakness 200A comprising a smaller number of lines of weakness.

Furthermore, as shown in FIG. 8, first line of weakness 100B and second line of weakness 200B formed in second face 10B of bag 11 for packaging are formed having opposite inclinations D200 and D100 with respect to the inclination of the breaks of the third line of weakness described above. First line of weakness 100B and second line of weakness 200B consist of single lines of weakness wherein groups of breaks are formed continuously, each group consisting of two breaks. In the second face 10B of this bag 11 for packaging, by setting of the inclination of the breaks of third line of weakness 300B as described above, it is arranged that the line of weakness that is actually employed during unsealing is first line of weakness 100B.

Just as in the case of second line of weakness 200A of first face 10A, first line of weakness 100B of the second face 10B is arranged in a condition adjacent third line of weakness 300B with practically no gap. Furthermore, if the breaks of third line of weakness 300B extend in straight lines along their direction of inclination with respect to third line of weakness 300B, these straight lines are arranged so as to cut across groups of breaks of first line of weakness 100A, each group of breaks consisting of two breaks of first line of weakness 100B.

In this way, unsealing line L10B can be more reliably trapped and then reliably converted in direction to the desired unsealing direction L50. Also, it is possible to construct first line of weakness 100B by only a single line of weakness, so the space required for formation of the line of weakness can be reduced.

The angle of inclination D200 of first line of weakness 100B, the width W200 of the breaks of second line of weakness 200A, the separation W100 between breaks of first line of weakness 100B, the separation W120 between groups of breaks of first line of weakness 100B and the separation W140 between two breaks constituting a group of breaks of first line of weakness 100B are suitably adjusted with a view to more reliable performance of trapping and conversion of direction of unsealing line L10B mentioned above, using first line of weakness 100B comprising a smaller number of lines of weakness.

While a preferred embodiment of the present invention has been described in detail above, the present invention is not restricted to the above embodiment.

Figure 9:
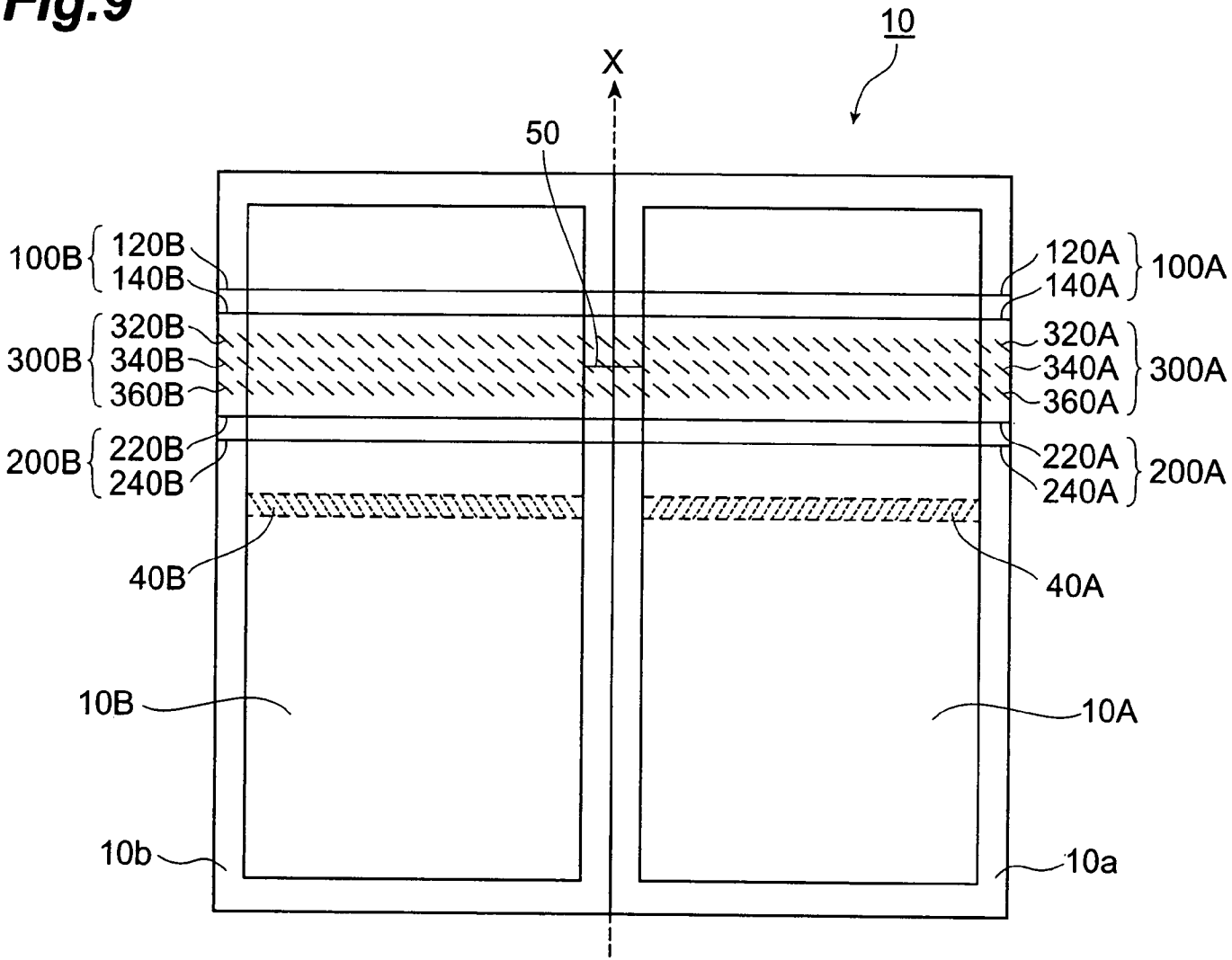
FIG. 9 is an opened-out view of a bag for packaging when the first line of weakness and second line of weakness are formed by linear break processing.
Figure 10:
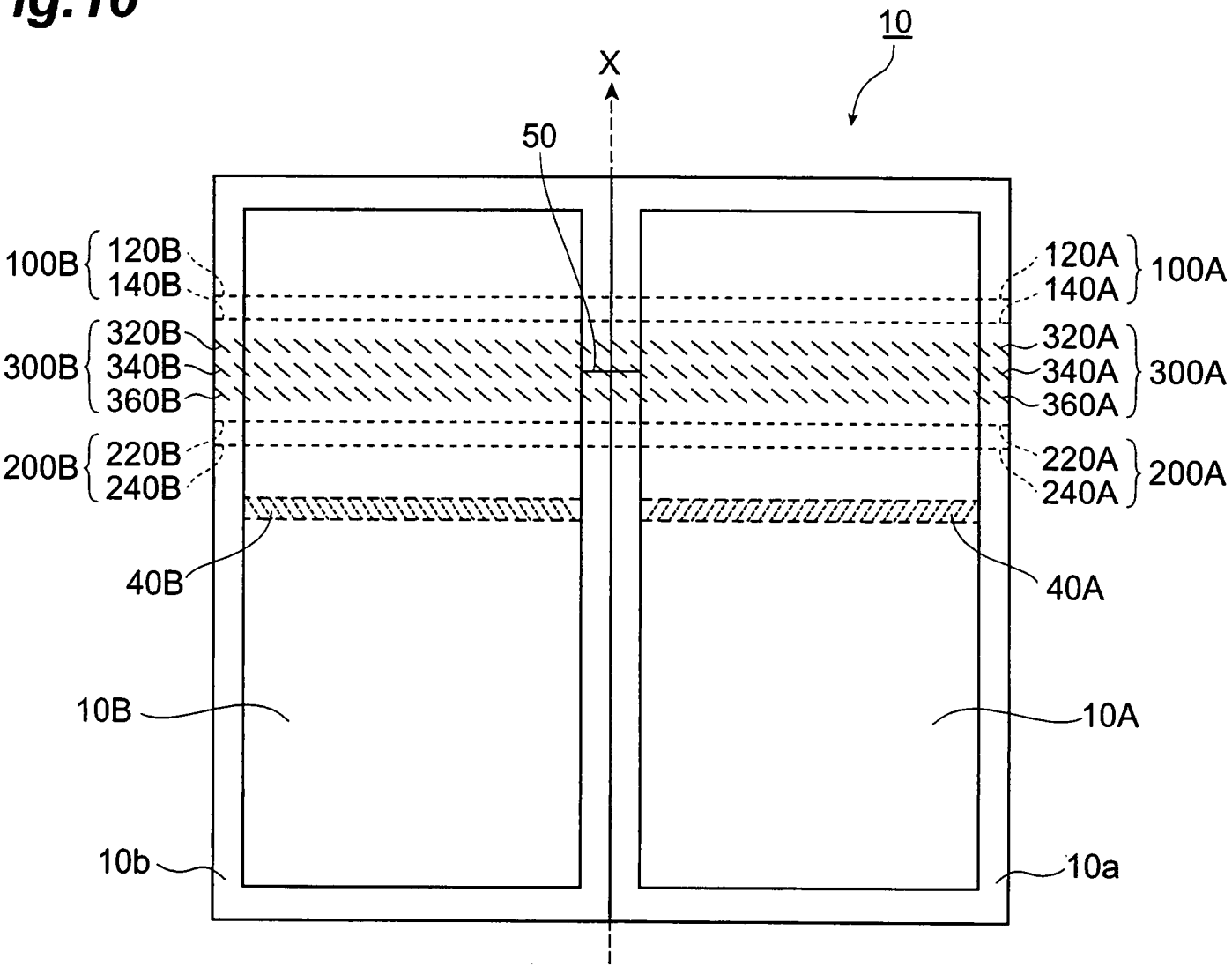
FIG. 10 is an opened-out view of a bag for packaging when the first line of weakness and second line of weakness are formed by break processing in the form of perforations.
Figure 11B:
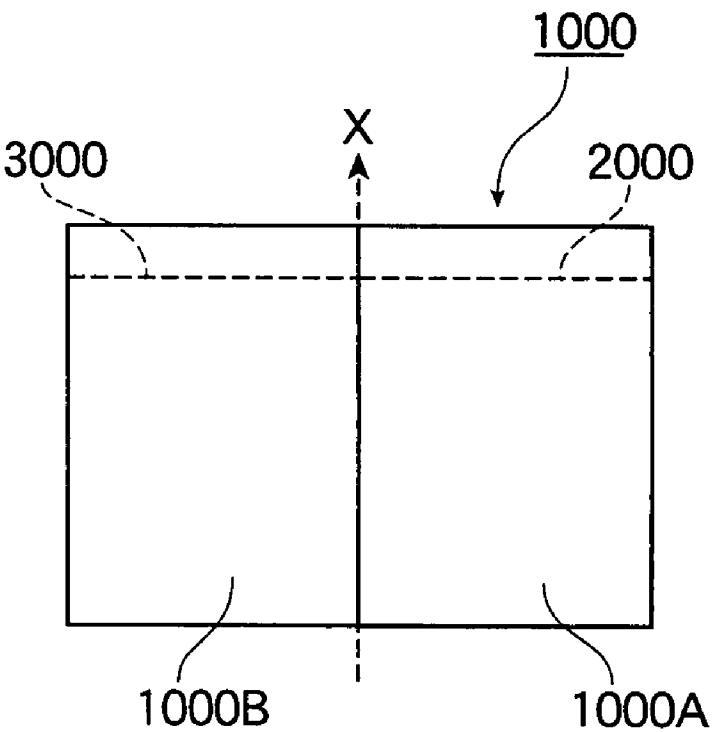
FIG. 11A is a front view showing the condition prior to unsealing of a conventional bag for packaging and FIG. 11B is an opened-out view showing the condition prior to unsealing of the conventional bag for packaging.
Figure 11A:
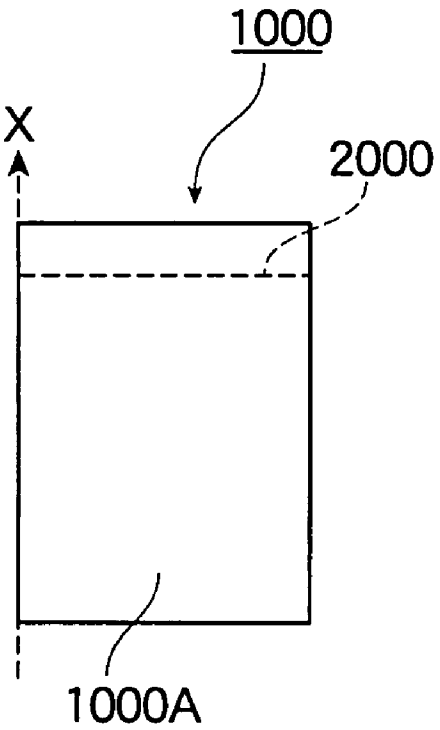
Figure 12B:
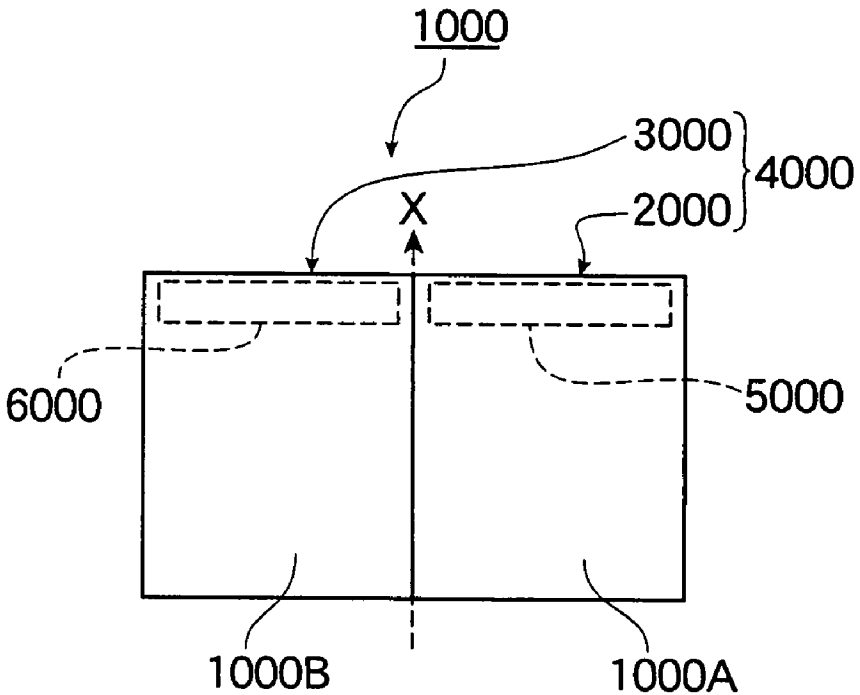
FIG. 12A is a front view showing the condition after unsealing of a conventional bag for packaging and FIG. 12B is an opened-out view showing the condition after unsealing of the conventional bag for packaging.
Figure 12A:
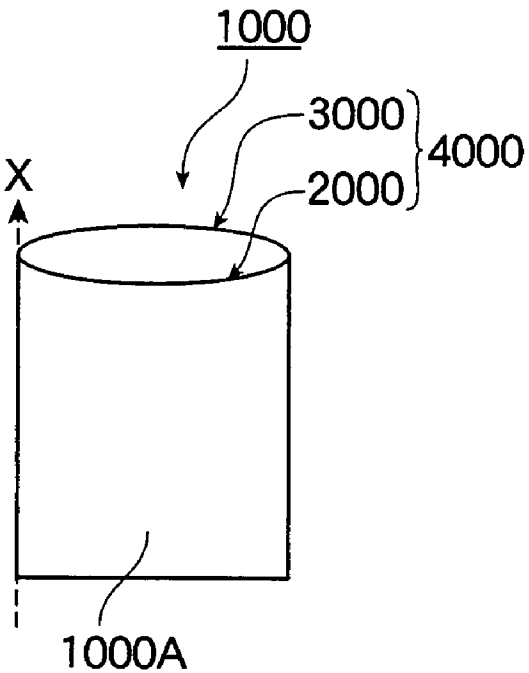

For example, in the bag for packaging of the present invention, the shapes of the first line of weakness and second line of weakness are not particularly restricted so long as they are capable of preventing deviation of the unsealing line from the desired unsealing direction by the force applied to the line of weakness portion on unsealing. For example, they could be linear shapes as shown in FIG. 9, shapes of the form of perforations as shown in FIG. 10, or shapes of the form of modified perforations. As shown in FIG. 9 and FIG. 10, the unsealing line after unsealing can be formed in a neat linear shape by forming the first line of weakness and second line of weakness constituting the border of the finger-grip portion produced after unsealing by break processing of linear or perforation form. Doing this is effective in the case of a bag for packaging that is comparatively easy to unseal in a desired unsealing direction, due to the material properties etc of the packaging material employed.

Although in FIG. 9 and FIG. 10 the number of first lines of weakness and second lines of weakness was two, there is no particular restriction regarding the number of these. In these cases also, the number of first lines of weakness and second lines of weakness is preferably 1 to 10 lines, depending on requirements. Further, although, in FIG. 9 and FIG. 10, lines of weakness were employed of the shape used earlier for the third line of weakness in the description of the first embodiment of the bag for packaging according to the present invention, the third line of weakness employed in the second embodiment of the bag for packaging according to the present invention could be used instead.

Also, "modified perforation form" indicates that breaks of the shape of for example an approximate "inverted V" shape, approximate Y shape, approximate L shape or approximately circular shape etc are formed continuously with a prescribed separation as described in Japanese utility model publication number 2566444. For example, in the case of an approximate "inverted V" shape, a pair of two breaks in the form of perforations are formed in inclined fashion so as to make an approximate "inverted V" shape; they are usually formed continuously with a prescribed separation towards the side where the approximately "inverted V" shaped breaks have their widest separation, with respect to the desired direction of tearing. In this way, an actual unsealing line that enters from the side where the breaks of the approximate "inverted V" shape have their widest separation issues from the side where the breaks have their narrowest separation, and so is controlled so as converge into the desired tearing direction. Furthermore, if approximate "inverted V" shapes are employed for the shapes of the first line of weakness and second line of weakness, the "inverted V" shaped breaks of the approximately "inverted V" shaped line of weakness may be arranged in alternately asymmetric fashion instead of being arranged in symmetric fashion with respect to the unsealing direction.

Also, so long as the first line of weakness and second line of weakness formed in the first face and second face are capable of preventing departure of the unsealing line from the desired unsealing direction as described above, they can be formed in mutually non-parallel fashion in the planes of the first face and second face.

Furthermore, the arrangement of the male portion and female portion of the plastic fastener in respect of the first face and second face can be the opposite of the arrangement in the bag for packaging of the above embodiments.

Also, the layer of the composite packaging material where the lines of weakness are formed may be formed as an internal layer rather than being laminated as the outermost layer of the composite packaging material.

Furthermore, the order of lamination of the layers constituting the composite packaging material is not restricted to that of the embodiments described above; for example, a plastic film layer constituting the layer where the lines of weakness are formed could be laminated as the outermost layer.

Also, although the case was described wherein composite packaging material having a four-layer structure was employed as the packaging material for forming the bag for packaging, in the bag for packaging according to the present invention, there is no particular restriction to this and a suitable selection may be made of the materials constituting the layers and of the numbers of layers in accordance with the articles to be packaged and their storage conditions: for example, the bag could be formed of a single layer of packaging material.

Furthermore, although a bag for packaging of a type sealed in four directions was described, the type of bag for packaging of the present invention is not restricted to this type and could be for example a type sealed in three directions.

Also, although a bag for packaging of a type formed with a notch was described, a type not formed with a notch could be employed.

PRACTICAL EXAMPLES

The details of a bag for packaging according to the present invention are described in further detail below with reference to practical examples and a comparative example but the present invention is not restricted in any way to these practical examples.

It should be noted that, when describing the practical examples and comparative example of the bag for packaging hereinbelow, for convenience in description, the same reference symbols are attached to portions that are the same as or correspond with structural elements of bag 11 for packaging shown in FIG. 7 and FIG. 8.

Practical Example 1

Respectively a first face 10A and second face 10B were produced by manufacturing two sheets of rectangular composite laminated film laminated of four layers, namely, from the outside, paper, plastic film (polyethylene), aluminum foil and plastic film (combined thickness of the four layers: 100 $\mu$m). Next, in the first face 10A and second face 10B of this bag for packaging there were formed a first line of weakness, second line of weakness and third line of weakness constituted of the same numbers of lines of weakness and having the same-shaped breaks as in the case of bag 11 for packaging are shown in FIG. 7 and FIG. 8.

Specifically, in the case of both the first face 10A and second face 10B, third line of weakness was constituted of eight lines of weakness in the same way as shown in FIG. 7 and FIG. 8. Also, in respect of these eight lines of weakness, the angle of inclination D300 of the breaks of each line of weakness with respect to the desired unsealing direction L50 was set to 40°, the width W300 of the breaks of each line of weakness was set to 1.2 mm, the prescribed separation W340 of the first group of lines of weakness and second group of lines of weakness with respect to the direction of the desired unsealing direction L50 was set to 0.46 mm and the prescribed separation W360 of the first group of lines of weakness and second group of lines of weakness with respect to the direction perpendicular to the desired unsealing direction L50 was set to 0.39 mm.

Also, in respect of the second line of weakness formed in first face 10A and second face 10B, just as in the case of that shown in FIG. 8, the angle of inclination D200 of the breaks constituting the second line of weakness with respect to the desired unsealing direction L50 was set to 35°, the width W200 of the breaks of the second line of weakness was set to 1.5 mm, the separation W220 between the groups of breaks of the second line of weakness was set to 1.84 mm and the separation W240 between the two breaks constituting groups of breaks of the second line of weakness was set to 0.92 mm.

Furthermore, regarding the first line of weakness formed in first face 10A and second face 10B, in the same way as in the case of that shown in FIG. 8, the angle of inclination D100 of the breaks constituting the first line of weakness with respect to the desired unsealing direction L50 was set to 35°, the width W100 of the breaks of the first line of weakness was set to 1.5 mm, the separation W120 between groups of breaks of the first line of weakness was set to 1.84 mm, and the separation W140 between the two breaks constituting groups of breaks of the first line of weakness was set to 0.92 mm.

Also, as a result of forming the lines of weakness as described above, the width in the direction perpendicular to the desired unsealing direction L50 of the third line of weakness as a whole was 3.47 mm, the width in the direction perpendicular to the desired unsealing direction L50 of the second line of weakness as a whole was 0.86 mm, the width in the direction perpendicular to the desired unsealing direction L50 of the first line of weakness as a whole was 0.86 mm and the width in the direction perpendicular to the desired unsealing direction L50 of the region of formation of the lines of weakness combining the third line of weakness, second line of weakness and first line of weakness was 5.19 mm.

In addition, a plastic fastener was provided below the first line of weakness. A bag for packaging was then manufactured having a 4-directional type of sealing by overlaying these two sheets of composite laminated film and sealing their peripheries. Shipping material was accommodated therein as the article to be packaged.

Practical Example 2

A bag for packaging was manufactured in the same way as in the case of practical example 1, apart from the use of six lines of weakness to constitute the third line of weakness.

As a result of the formation of the third line of weakness in this way, the width in the direction perpendicular to the desired unsealing direction L50 of the third line of weakness as a whole was 2.70 mm and the width in the direction perpendicular to the desired unsealing direction L50 of the region of formation of the lines of weakness combining the third line of weakness, second line of weakness and third line of weakness was 4.42 mm.

Practical Example 3

A bag for packaging was manufactured in the same way as in the case of practical example 1 apart from the use of 10 lines of weakness to constitute the third line of weakness.

As a result of forming the third line of weakness in this way, the width in the direction perpendicular to the desired unsealing direction L50 of the third line of weakness as a whole was 4.24 mm and the width in the direction perpendicular to the desired unsealing direction L50 of the region of formation of the lines of weakness combining the third line of weakness, second line of weakness and first line of weakness was 5.96 mm.

Comparative Example 1

A bag for packaging was manufactured in the same way as in practical example 1 apart from the fact that a single line of weakness was used to constitute the third line of weakness and no first line of weakness or second line of weakness was formed.

[Evaluation Test of the Ease of Opening and Closing Unsealing Aperture after Unsealing]

Distributing a single sample to each user, 10 users were asked to unseal the samples shown in practical examples 1 to 3 and comparative example 1 from the end of the portion of the third line of weakness and, regarding opening/closure of the unsealed aperture produced after unsealing of these samples, evaluations were obtained as to whether or not opening/closure could be performed easily, by comparing the ease of gripping the finger-grip portions produced after unsealing.

Table 1 shows the results of the tests of these samples in regard to ease of opening/closure of the unsealing aperture after unsealing and attractiveness of its appearance, in accordance with the following evaluation standards: 3: the unsealing line produced at the location between the first line of weakness and second line of weakness was torn neatly and practically horizontally, having a sufficiently large finger-grip portion which was easy to grip with the fingers; 2: small separation of the unsealing line produced at the location between the first line of weakness and second line of weakness, having a finger-grip portion which was not of sufficient size and so rather difficult to grip with the fingers; 1: unsealing line completely coincident therewith so that no finger-grip portion at all was formed and hence extremely difficult to grip with the fingers.

TABLE 1

| | Ease of opening/closing of unsealed aperture after unsealing |
|---|---|
| Practical example 1 | 3 |
| Practical example 2 | 3 |
| Practical example 3 | 3 |
| Comparative example 1 | 1 |

As is clear from the results shown in Table 1, in the case of the bag for packaging of practical examples 1 to 3 of the present invention, a suitable step is produced on the unsealing line formed on the first face and a second face, by effectively utilizing the inclination of the breaks of the third line of weakness and the unsealing line is formed neatly, parallel to the desired unsealing direction, thanks to the first line of weakness and second line of weakness; consequently, the finger-grip portion is formed in projecting fashion at the unsealing aperture after unsealing, which finger-grip portion can easily be gripped with the fingertips. It was confirmed that this unsealed aperture could easily be opened and closed.

INDUSTRIAL APPLICABILITY

As described above, with a bag for packaging according to the present invention, a suitable finger-grip portion is formed at the unsealed aperture of the bag for packaging after unsealing, in accordance with the inclination of the breaks in the form of perforations constituting a third line of weakness arranged between a first line of weakness and second line of weakness; thus this finger-grip portion can easily be gripped with the fingertips. Also, the first line of weakness, second line of weakness and third line of weakness can easily be formed so this can easily be manufactured using packaging material formed with the same first line of weakness, second line of weakness and third line of weakness. A bag for packaging can therefore be provided which is easy to manufacture, wherein the unsealing operation is easy and wherein opening/closure of the unsealed aperture after unsealing can also easily be achieved.

What is claimed is:

1. A bag for packaging comprising a first face and a second face that are mutually opposite, wherein a first line of weakness and a second line of weakness and a third line of weakness constituted by a plurality of breaks of perforation form arranged between said first line of weakness and said second line of weakness and having an inclination with respect to a prescribed unsealing direction are respectively formed in said first face and said second face such that the first, second and third lines of weakness are arranged in mutually parallel fashion, with respect to each and wherein said plurality of breaks of perforation form constituting said third line of weakness formed in said first face and said plurality of breaks of perforation form constituting said third line of weakness formed in said second face are formed inclined in opposite crossing directions with respect to each other.

2. The bag for packaging according to claim 1, wherein said third line of weakness is formed as an assembly consisting of 1 to 10 lines of weakness.

3. The bag for packaging according to claim 1, wherein said plurality of breaks of perforation form constituting said third line of weakness are formed so as to have an inclination of 25 to 45° with respect to said prescribed unsealing direction.

4. The bag for packaging according to claim 1, wherein at least one of said first line of weakness and said second line of weakness are formed as assemblies consisting of 1 to 10 lines of weakness.

5. The bag for packaging according to claim 1, wherein:

said first line of weakness and said second line weakness are respectively constituted by a plurality of breaks of perforation form having an inclination with respect to a prescribed unsealing direction;

said plurality of breaks of perforation form constituting said first line of weakness formed in said first face and said plurality of breaks of perforation form constituting said third line of weakness formed in said first face are formed inclined in mutually opposite directions with respect to said prescribed unsealing direction;

said plurality of breaks of perforation form constituting said first line of weakness formed in said second face and said plurality of breaks of perforation form constituting said third line of weakness formed in said second face are formed inclined in mutually opposite directions with respect to said prescribed unsealing direction;

said plurality of breaks of perforation form constituting said second line of weakness formed in said first face and said plurality of breaks of perforation form constituting said third line of weakness formed in said first face are formed inclined in mutually opposite directions with respect to said prescribed unsealing direction; and said plurality of breaks of perforation form constituting said second line of weakness formed in said second face and said plurality of breaks of perforation form constituting said third line of weakness formed in said second face being formed inclined in mutually opposite directions with respect to said prescribed unsealing direction.

6. The bag for packaging according to claim 5 wherein said plurality of breaks of perforation form constituting said first line of weakness and said second line of weakness are respectively formed so as to have an inclination of 25 to 45° with respect to said prescribed unsealing direction.

7. The bag for packaging according to claim 1 further comprising unsealing means that seals the unsealed aperture after unsealing.

8. The bag for packaging according to claim 1 wherein said bag for packaging is formed of composite packaging material comprising at least one sealing layer that holds the article for packaging in a stable gas-tight condition and at least one layer having said first line of weakness, said second line of weakness and said third line of weakness.

9. The bag for packaging according to claim 8 wherein said sealing layer is an aluminum layer.

10. A bag for packaging comprising a first face and a second face that are mutually opposite, wherein a first line of weakness and a second line of weakness and a third line of weakness constituted by a plurality of breaks of perforation form arranged between said first line of weakness and said second line of weakness and having an inclination with respect to a prescribed unsealing direction are respectively formed in said first face and said second face such that the first, second and third lines of weakness are arranged in mutually parallel fashion, with respect to each wherein said plurality of breaks of perforation form constituting said third line of weakness formed in said first face and said plurality of breaks of perforation form constituting said third line of weakness formed in said second face are formed inclined in opposite directions with respect to each other, and a notch for unsealing formed at the end of said third line of weakness.

* * * * *